US007754410B2

(12) United States Patent
Ishiyama et al.

(10) Patent No.: US 7,754,410 B2
(45) Date of Patent: Jul. 13, 2010

(54) PRODUCTION METHOD OF STATIC CHARGE IMAGE DEVELOPING TONER AND SCREEN DEVICE

(75) Inventors: Shingo Ishiyama, Yokkaichi (JP); Nobuyuki Aoyagi, Yokkaichi (JP)

(73) Assignee: Mitsubishi Chemical Corporation, Tokyo (JP)

( * ) Notice: Subject to any disclaimer, the term of this patent is extended or adjusted under 35 U.S.C. 154(b) by 125 days.

(21) Appl. No.: 12/064,413

(22) PCT Filed: Aug. 23, 2006

(86) PCT No.: PCT/JP2006/316514

§ 371 (c)(1), (2), (4) Date: Feb. 21, 2008

(87) PCT Pub. No.: WO2007/023861

PCT Pub. Date: Mar. 1, 2007

(65) Prior Publication Data

US 2009/0117487 A1 May 7, 2009

(30) Foreign Application Priority Data

Aug. 23, 2005 (JP) ..... 2005-241528

(51) Int. Cl.
*G03G 5/00* (2006.01)

(52) U.S. Cl. ..... 430/137.15; 430/137.1

(58) Field of Classification Search ..... 430/137.1, 430/137.15

See application file for complete search history.

(56) References Cited

U.S. PATENT DOCUMENTS

2006/0046178 A1* 3/2006 Akiyama et al. ..... 430/108.23

FOREIGN PATENT DOCUMENTS

JP 2000 172007 6/2000
JP 2001 249491 9/2001
JP 2002 196534 7/2002
JP 2004 198793 7/2004
JP 2004 245990 9/2004
JP 2004 337784 12/2004
JP 2005 193155 7/2005

* cited by examiner

*Primary Examiner*—Hoa V Le
(74) *Attorney, Agent, or Firm*—Oblon, Spivak, McClelland, Maier & Neustadt, L.L.P.

(57) ABSTRACT

To provide a method for producing a toner for developing an electrostatic charge image, which is capable of producing toner host particles in good yield and which is excellent in image characteristics, image quality, scratch resistance of a developing device and toner consumption, and a screen device which is capable of screening continuously without clogging.

A method for producing a toner for developing an electrostatic charge image, which comprises a step of screening a dispersion of toner host particles by a screen, characterized in that when the above step is carried out, $Y \leqq \{1/(M^2+r^2+2Mr)\} \times 10^8 \times 0.6$ is satisfied where Y is the number of particles (number/$cm^2$) existing on the screen and having sizes of at least the mesh size of the screen, M is the mesh size (μm) of the screen, and r is the diameter (μm) of wire constituting the screen; a screen device characterized in that the screen is one wherein the shape of the minimum opening unit to let particles pass therethrough, changes from the stationary state by vibration in the screening step; a screen device characterized in that the screen is one to which substantially no tension is applied; and a method for producing a toner for developing an electrostatic charge image, which employs such a screen device.

11 Claims, No Drawings

PRODUCTION METHOD OF STATIC CHARGE IMAGE DEVELOPING TONER AND SCREEN DEVICE

TECHNICAL FIELD

The present invention relates to a method for producing a toner for developing an electrostatic charge image, and a screen device. More particularly, it relates to a method for producing a toner for an electrostatic charge image, which is capable of producing a toner for developing an electrostatic charge image excellent in image characteristics, image quality, scratch resistance of a developing device, etc. efficiently in good yield, and a screen device which is capable of screening continuously without clogging.

BACKGROUND ART

By an electrophotographic system, a visible image is formed usually in such a manner that firstly an electrostatic latent image is formed on a photoconductor drum, and then, it is developed with a toner, then transferred to e.g. transfer paper and fixed by e.g. heat. As such a toner for developing an electrostatic charge image, it is common to use one having an auxiliary agent deposited for the propose of imparting various properties such as flowability, on the surface of toner host particles obtained by a so-called melt-kneading pulverization method i.e. a method wherein a binder resin and a colorant are dry-blended with an antistatic agent, a release agent, a magnetic material, etc. as the case requires, and the mixture is melt-kneaded by e.g. an extruder, followed by pulverization and classification.

In recent years, a high image quality is regarded as a performance desired for printers and copying machines, and in order to accomplish such a high image quality, the above-mentioned toner host particles are required to have a volume average particle diameter at a level of from 4 to 8 μm and a narrow particle diameter distribution. However, in the above-mentioned melt-kneading pulverization, it is difficult to control the particle diameters of the toner host particles, and if it is attempted to obtain toner host particles having a volume average particle diameter at a level of from 4 to 8 μm, a large amount of fine powder having a particle diameter below the desired level is likely to be naturally formed, and there has been a problem that it is difficult to separate such a fine powder in the classification step.

As a method for overcoming the above problem in the melt-kneading pulverization method, (a) a suspension polymerization method wherein a polymerizable monomer, a polymerization initiator, a colorant, etc. are suspended and dispersed in an aqueous medium, followed by polymerization to prepare toner host particles, (b) an emulsion polymerization flocculation method wherein a polymerizable monomer is emulsified in an aqueous medium containing an polymerization initiator, an emulsifier, etc., and the polymerizable monomer is polymerized with stirring to obtain a dispersion of polymer primary particles, then a colorant, etc. are added to the dispersion, followed by flocculation and aging of the polymer primary particles to prepare toner host particles, or (c) a dissolution suspension method wherein a dissolution dispersion (dissolution dispersion of toner composition) having a polymer, a colorant, etc. preliminarily dissolved or dispersed in a solvent, is dispersed in an aqueous medium, and the solvent is removed by e.g. reducing the pressure for heating the dispersion to prepare toner host particles.

By such wet methods, it is possible to obtain toner host particles having small particle diameters and relatively narrow particle diameter distribution. However, simply by adopting such methods, no adequate results have been obtained for controlling the shape of the toner host particles or for making the particle diameters to be uniform.

Further, for copying machines or printers of recent years, still higher levels of image characteristics and image quality are required, and a toner is required which presents no adverse effects with respect to scratching, abrasion, etc. also against components constituting an image-forming device. For such a purpose, a higher level of control of the particle diameter of the toner is required, and it is particularly important that a coarse (large particle diameter) toner is less.

If toner host particles are prepared by such wet methods, it is certainly possible to obtain ones having a low content of coarse particles as compared with toner host particles prepared by the melt-kneading pulverization method, but even by such wet methods, it was not possible to sufficiently reduce coarse particles. Various reasons may be considered, but in the case of toner host particles by wet methods, agglomeration of toner host particles one another in a state dispersed in an aqueous medium or deposition in the container during polymerization or dissolution is, for example, considered to be a cause.

Therefore, heretofore, it has, for example, been common that as shown in Patent Document 1, toner host particles are dried, and an auxiliary agent is deposited on the surface of the toner host particles, and then coarse particles in the toner host particles are removed by screening. However, merely by such a dry screening step after addition of an auxiliary agent, clogging of the screen is likely to take place, whereby the yield is poor, and the process is not efficient, and further, by the presence of coarse particles at the time before the addition of the auxiliary agent to the toner host particles, there has been a problem that the agglomeration is accelerated at the time of addition of the auxiliary agent.

On the other hand, in the production of toner host particles by wet methods, the process may have a filtration step, and such a filtration step is intended to remove a suspension stabilizer or emulsifier, impurities or by-products, or fine particles with small particle diameters, and it has been common not to include a step intended to remove coarse particles larger than the toner host particles.

Under the circumstances, Patent Documents 2 and 3 disclose a process for removing coarse particles in such toner host particles. However, the techniques disclosed in such Patent Documents have had a problem that when a toner dispersion is supplied continuously, the screen mesh tends to be clogged with coarse particles, and in the step of removing coarse particles, the toner dispersion is likely to overflow from the screen.

Further, Patent Documents 4 to 6 disclose techniques to solve such clogging of coarse particles. However, even by such techniques, although very large particles as compared with the screen mesh may be continuously removed, particles having particle diameters close to the mesh size or particles corresponding to the mesh size still tend to clog the mesh, whereby it has been difficult to carry out screening continuously.

Therefore, as disclosed in Patent Document 7, a screening method has been developed to avoid clogging by supplying the dispersion of toner host particles inversely, but this method tends to lead retention of toner host particles and is not a productive method.

Thus, heretofore, it has not been clearly understood how to remove coarse particles efficiently from the toner by wet methods and to obtain a toner for developing an electrostatic charge image excellent in image characteristics, image quality, scratch-resistance of a developing device, etc., and no screen device has been available to accomplish it.

Patent Document 1: JP-A-2001-249491
Patent Document 2: JP-A-2000-172007
Patent Document 3: JP-A-2002-196534
Patent Document 4: JP-A-2004-198793
Patent Document 5: JP-A-2004-245990
Patent Document 6: JP-A-2005-193155
Patent Document 7: JP-A-2004-337784

DISCLOSURE OF THE INVENTION

Object to be Accomplished by the Invention

The present invention has been made in view of such prior art, and its object is to provide a method for producing a toner for developing an electrostatic charge image excellent in image characteristics, image quality, scratch resistance of a developing device and toner consumption, which is capable of producing toner host particles by a wet method efficiently in good yield, a screen device which makes it possible to carry out screening continuously without clogging.

Means to Accomplish the Object

The present inventors have conducted an extensive study to accomplish the above object and as a result, have found that in a process for producing a toner for developing an electrostatic charge image, which comprises a step of screening a dispersion of toner host particles, it is possible to accomplish the above object by letting toner host particles in a state dispersed in water pass through a screen in a specific manner. The present invention has been accomplished on the basis of such a discovery.

Namely, the present invention provides a method for producing a toner for developing an electrostatic charge image, which comprises a step of screening a dispersion of toner host particles by a screen, characterized in that when the above step is carried out, the following formula (1) is satisfied:

$$Y \leqq \{1/(M^2+r^2+2Mr)\} \times 10^8 \times 0.6 \quad (1)$$

where Y is the number of particles (number/cm$^2$) existing on the screen and having sizes of at least the mesh size of the screen, M is the mesh size (μm) of the screen, and r is the diameter (μm) of wire constituting the screen.

Further, the present invention provides a screen device provided with a screen, characterized in that the screen is one wherein the shape of the minimum opening unit of the screen to let particles pass therethrough, changes from the stationary state by vibration during the screening step.

Further, the present invention provides a screen device provided with a screen, characterized in that the screen is one to which substantially no tension is applied.

Further, the present invention provides a screen device provided with a screen, characterized in that the screen is made of, as the main material, a material having a Young's modulus of at most 100 GPa, and the area is ($S_2$) of the screen when the screen existing in the fixed portion of the screen is spread flatly, is larger than the area ($S_1$) of the opening for screening in the fixed portion of the screen.

Further, the present invention provides a method for producing a toner for developing an electrostatic charge image, which comprises a step of screening a dispersion of toner host particles by using the screen device as defined above.

EFFECTS OF THE INVENTION

According to the present invention, it is possible to provide a method for producing a toner for developing an electrostatic charge image which is capable of producing a toner for developing an electrostatic charge image excellent in image characteristics, image quality, scratch resistance of a developing device, toner consumption, etc., efficiently in good yield by continuous screening, and to provide a screen device which makes such a method possible. Further, it is possible to carry out continuous operation without clogging, whereby a large treating ability can be obtained with a small size screen, the installation cost can be reduced, the life of the screen can be prolonged, and thus the running cost can be made low.

BEST MODE FOR CARRYING OUT THE INVENTION

In the production method of the present invention, the method for producing toner host particles contained in the dispersion is not particularly limited. However, such particles are preferably ones prepared by a wet method. The wet method is a method for producing a toner for developing an antistatic charge image, wherein a dispersion medium such as water is employed in the step for producing the toner host particles. For example, (a) a suspension polymerization wherein a polymerizable monomer, a polymerization initiator, a colorant, etc. are suspended and dispersed in an aqueous medium, followed by polymerization to prepare toner host particles, (b) an emulsion polymerization flocculation method wherein a polymerizable monomer is emulsified in an aqueous medium containing a polymerization initiator, an emulsifier, etc., the polymerizable monomer is polymerized with stirring to obtain a dispersion of polymer primary particles, to which a colorant, etc. are added, followed by flocculation and aging of the polymer primary particles to prepare the toner host particles, or (c) a dissolution suspension method wherein a dissolution dispersion (dissolution dispersion of toner composition) having a polymer, a colorant, etc. preliminarily dissolved or dispersed in a solvent, is dispersed in an aqueous medium, and the solvent is removed by e.g. reduced pressure or heating the dispersion, to prepare toner host particles dispersed in the aqueous medium, may be mentioned.

Now, with respect to the method for producing a toner for developing an electrostatic charge image of the present invention, items common to all wet methods will be described in detail.

The toner for developing an electrostatic charge image produced by the method of the present invention is one having solid fine particles externally added, as the case requires, to toner host particles which comprise a binder resin and a colorant and may contain wax, an electrification-controlling agent and other additives, as the case requires.

As the binder resin to be used for the present invention, known various resins suitable for toners may be used. For example, a styrene resin, a polyester resin, an epoxy resin, a polyurethane resin, a vinyl chloride resin, a polyethylene, a polypropylene, an ionomer resin, a silicone resin, a rosin-modified maleic acid resin, a phenol resin, a ketone resin, a ethylene/ethyl acrylate copolymer or a polyvinylbutyral resin may be mentioned, and they may be used in combination as a mixture. As a particularly preferred resin to be used for the present invention, a styrene resin may be mentioned.

The styrene resin may be a homopolymer or a copolymer containing styrene or a styrene-derivative, such as a polystyrene, a chloropolystyrene, a poly-α-methylstyrene, a styrene/ chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer (such as a styrene/methyl acrylate copolymer, a styrene/ethyl acrylate copolymer, a styrene/butyl acrylate copolymer, a styrene/octyl acrylate copolymer or a styrene/phenyl acrylate copolymer), a styrene/acrylate/acrylic acid copolymer (such as a styrene/methyl acrylate/acrylic acid copolymer, a styrene/ethyl acrylate/acrylic acid copolymer, a styrene/butyl acrylate/acrylic acid copolymer, a styrene/octyl acrylate/acrylic acid copolymer, a styrene/phenyl acrylate/acrylic acid copolymer), a styrene/acrylate/methacrylic acid copolymer (such as a styrene/methyl acrylate/methacrylic acid copolymer, a styrene/ethyl acrylate/methacrylic acid copolymer, a styrene/butyl acrylate/methacrylic acid copolymer, a styrene/octyl acrylate/methacrylic acid copolymer or a styrene/phenyl acrylate/methacrylic acid copolymer), a styrene/methacrylate copolymer (such as a styrene/methyl methacrylate copolymer, a styrene/ethyl methacrylate copolymer, a styrene/butyl methacrylate copolymer, a styrene/octyl methacrylate copolymer, or a styrene/phenyl methacrylate copolymer), a styrene/methacrylate/acrylic acid copolymer (such as a styrene/methyl methacrylate/acrylic acid copolymer, a styrene/ethyl methacrylate/acrylic acid copolymer, a styrene/butyl methacrylate/acrylic acid copolymer, a styrene/octyl methacrylate/acrylic acid copolymer or a styrene/phenyl methacrylate/acrylic acid copolymer), a styrene/methacrylate/methacrylic acid copolymer (such as a styrene/methyl methacrylate/methacrylic acid copolymer, a styrene/ethyl methacrylate/methacrylic acid copolymer, a styrene/butyl methacrylate/methacrylic acid copolymer, a styrene/octyl methacrylate/methacrylic acid copolymer or a styrene/phenyl methacrylate/methacrylic acid copolymer), a styrene/methyl α-chloroacrylate copolymer, or a styrene/acrylonitrile/acrylate copolymer. It may be their mixture. Further, one having a part or whole of the above acrylic acid or methacrylic acid substituted by a substituted monocarboxylic acid such as α-chloroacrylic acid or α-bromoacrylic acid, an unsaturated dicarboxylic acid such as fumaric acid, maleic acid, maleic anhydride or monobutyl maleate, an anhydride thereof or a half ester thereof, may also be suitably used.

Among them, it is preferably a binder resin selected from a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer and a styrene/methacrylate/methacrylic acid copolymer. It is particularly preferably a binder resin having acid groups selected from a styrene/acrylate/acrylic acid copolymer, a styrene/acrylate/methacrylic acid copolymer, a styrene/methacrylate/acrylic acid copolymer and a styrene/methacrylate/methacrylic acid copolymer, since the affinity-dispersibility with a fixing aid is thereby improved, and as formed into a toner, the fixing property or durability will be excellent and yet the electrostatic stability (particularly the negative electrostatic property) of the toner will be thereby improved. Further, the ester group in the acrylate or methacrylate is not particularly limited, and it may, for example, be a methyl ester, an ethyl ester, a butyl ester, an octyl ester or a phenyl ester.

The glass transition temperature (hereinafter referred to as "Tg") of the above binder resin as measured by a differential scanning calorimeter (hereinafter referred to as "DSC") is preferably at least 40° C., more preferably at least 50° C. and preferably at most 80° C., more preferably at most 70° C. If Tg exceeds 80° C., the low temperature fixing property of the obtained toner is likely to deteriorate, or when a full color toner is prepared, the transparency of the toner may not be obtained. On the other hand, if Tg is less than 40° C., the storage stability, blocking resistance, etc. of the toner may sometimes deteriorate. In the present invention, Tg is a value obtained as a temperature at the intersection of two tangent lines, when the tangent lines is are drawn at the transition (curvature change) initiation portions of a curve measured by a differential scanning calorimeter (DTS-40, manufactured by Shimadzu Corporation) under a condition of a temperature raising rate of 10° C./min.

Further, in the gel permeation chromatography (hereinafter referred to as "GPC") of the binder resin to be used in the present invention, at least one of the peak molecular weights is preferably at least 3,000, more preferably at least 10,000, further preferably at least 30,000 and preferably at most 100,000, more preferably at most 70,000, further preferably at most 60,000. If the peak molecular weight is less than 3,000, the fixing property may be good, but a photo-offset is likely to occur, and the useful temperature range tends to be narrow. Further, if it exceeds 100,000, the fixing property in a low temperature range tends to be poor, and the fixing lower limit temperature tends to rise. In the present invention, in the GPC measurement, using tetrahydrofuran as a solvent, a solvent-insoluble content is filtered off, and only a soluble content is measured, and the molecular weight is a value calibrated by standard polystyrene.

The colorant to be used in the present invention is not particularly limited, and various inorganic and organic dyes or pigments which are commonly used as colorants for toners, may, for example, be used. Specifically, it may, for example, be an inorganic pigment such as a metal powder such as iron powder or copper powder, a metal oxide such as red oxide or a carbon represented by carbon black such as furnace black or lamp black, an acid dye or basic dye, such as an azo dye such as benzidine yellow or benzidine orange, a precipitate by a precipitating agent of a dye such as quinoline yellow, acid green or alkali blue, or a precipitate by tannic acid or phosphomolybdic acid of a dye such as rhodamine, magenta or malachite green, a dye such as a metal salt of a hydroxyanthraquinone, an organic pigment of e.g. a phthalocyanine type such as phthalocyanine blue or phthalocyanine copper sulfonate, a quinacridone type such as quinacridone red or quinacridone violet, or a dioxane type, or a synthetic dye such as aniline black, an azo dye, a naphthoquinone dye, an indigo dye, a nigrosine dye, a phthalocyanine dye, a polymethine dye, a di- or tri-aryl methane dye. Two or more of them may be used in combination.

As colorants to be used for a full color toner, one for yellow is, for example, an azo type pigment (such as an insoluble monoazo type, an insoluble disazo type or a condensed azo type) or a polycyclic pigment (such as an isoindoline type, an isoindolinone type, a slen type or a quinophthalone type), one for magenta is, for example, an azo type pigment (such as an azo lake type, an insoluble monoazo type, an insoluble disazo type or a condensed azo type) or a polycyclic pigment (such as a quinacrydone pigment or a perylene pigment) and one for cyan is, for example, a phthalocyanine pigment or a slen pigment. The combination of colorants may optionally be selected in consideration of the hue, etc., but among them, as a yellow colorant, at least one member selected from C.I. pigment yellow 74, C.I. pigment yellow 93 and C.I. pigment yellow 155 is preferably employed, as a magenta colorant, at least one member selected from C.I. pigment red 238, C.I. pigment red 269, C.I. pigment red 57:1, C.I. pigment red 48:2 and C.I. pigment red 122 is preferably employed, as a cyan colorant, at least one member selected from C.I. pigment blue 15 and C.I. pigment blue 15:3 is preferably employed, and as a black colorant, a furnace carbon black is preferably employed.

The content of the above colorant is preferably from 1 to 20 parts by weight, more preferably from 2 to 15 parts by weight, particularly preferably from 3 to 10 parts by weight, per 100 parts by weight of the above binder resin. When two or more colorants are used in combination, their total amount is preferably in the above range.

Further, the colorant may have magnetism, and the magnetic colorant may be a ferromagnetic substance showing ferrimagnetism or ferromagnetism in the vicinity of from 0 to 60° C. which is the operation temperature of copying machines, etc. Specifically, it may, for example, be magnetite ($Fe_3O_4$), maghematite ($\gamma$-$Fe_2O_3$), an intermediate or mixture of magnetite and maghematite, a spinel ferrite of $M_xFe_{3-x}O_4$ (wherein M is Mg, Mn, Fe, Co, Ni, Cu, Zn, Cd or the like), a hexagonal ferrite such as $BaO.6Fe_2O_3$ or $SrO.6Fe_2O_3$, a garnet oxide such as $Y_3Fe_5O_{12}$ or $Sm_3Fe_5O_{12}$, a butyl type oxide such as $CrO_2$, or one showing magnetism at a temperature in the vicinity of from 0 to 60° C. among metals such as Cr, Mn, Fe, Co and Ni, and their ferromagnetic alloys. Among them, magnetite, maghematite or an intermediate of magnetite and maghematite is preferred. In a case where such a magnetic colorant is added with a view to preventing scattering or controlling the electrostatic property, while the characteristics as a non-magnetic toner are maintained, its amount is from 0.5 to 10 parts by weight, preferably from 0.5 to 8 parts by weight, more preferably from 1 to 5 parts by weight, per 100 parts by weight of the above binder resin.

The toner for developing an electrostatic charge image in the present invention may contain wax. It is preferred to contain wax, since it is thereby possible to improve e.g. the low temperature fixing property, the high temperature off-set resistance or the filming resistance.

Such wax is not particularly limited so long as it is one commonly used for toners. Specifically, it may, for example, be an olefin wax such as a low molecular weight polyethylene, a low molecular weight polypropylene or a copolymer polyethylene; paraffin wax; a silicone wax having alkyl groups, a higher fatty acid such as stearic acid; a long chain aliphatic alcohol such as eicosanol; an ester type wax having a long chain aliphatic group, such as behenyl behenate, a montanate or stearyl stearate; a ketone having a long chain alkyl group such as distearyl ketone; a vegetable wax such as hydrogenated castor oil carnauba wax; an ester or a partial ester obtainable from a polyhydric alcohol such as glycerol or pentaerythritol and a long chain fatty acid; a higher fatty acid amide such as oleic amide or stearic amide; or a low molecular weight polyester. A wax suitable for the present invention may be suitably selected for use from an ester type wax, a paraffin wax, an olefin type wax such as a low molecular weight polyethylene or a copolymer polyethylene, and a silicone wax having an alkyl group. Further, wax preferably has at least one heat absorption peak by DSC within a range of from 50 to 100° C.

When wax is incorporated, its content is preferably at least 0.05 part by weight, more preferably at least 0.1 part by weight, further preferably at least 1 part by weight and preferably at most 20 parts by weight, more preferably at most 15 parts by weight, per 100 parts by weight of the toner.

With respect to the dispersed particle diameter of wax in the toner for developing an electrostatic charge image in the present invention, the volume average particle diameter is preferably at least 0.1 μm, more preferably at least 0.3 μm and preferably at most 3 μm, more preferably at most 1 μm. If the average particle diameter is less than 0.1 μm, the effect to improve the release property of the toner may not be sufficient, and if the average particle diameter exceeds 3 μm, it tends to be exposed on the toner surface, whereby the electrostatic property or heat resistance is likely to deteriorate. Here, the average particle diameter of wax can be determined not only by a method wherein the toner is made into a thin film and observed by an electron microscope, but also by a method wherein a binder resin of the toner is dissolved by e.g. an organic solvent in which wax will not be dissolved, and the particle diameter of wax in the solution is measured.

To the toner for developing an electrostatic charge image in the present invention, an electrification-controlling agent may be incorporated in order to adjust the electrostatic charge or to impart the electrostatic stability. As such an electrification-controlling agent, a known compound may be used. For example, a positively chargeable electrification-controlling agent may, for example, be a nigrosine dye, a quaternary ammonium salt, a triaminotriphenylmethane compound, an imidazole compound or a polyamine resin. A negatively chargeable electrification-controlling agent may, for example, be an azo complex compound dye containing an atom such as Cr, Co, Al, Fe or B, an alkyl salicylic complex compound or a calyx(n)arene compound. For a blue color toner, it is necessary to choose the color of the electrification-controlling agent to be colorless or pale color in order to avoid a coloring trouble. For this purpose, the positively chargeable electrification-controlling agent is preferably a quaternary ammonium salt or a imidazole compound, and the negatively chargeable electrification-controlling agent is preferably an alkyl salicylic acid complex compound containing an atom such as Cr, Co, Al, Fe or B, or a calyx(n)arene compound, among those mentioned above. Otherwise, it may be a mixture thereof. The amount of the electrification-controlling agent is preferably within a range of from 0.01 to 5 parts by weight, per 100 parts by weight of the binder resin.

Further, the toner of the present invention may contain various known internal additives such as silicone oil or silicone varnish for modification of the viscosity, flocculation property, flowability, electrostatic property, surface resistance, etc., of the toner.

In the method for producing a toner for developing an electrostatic charge image of the present invention, toner host particles obtained by e.g. a wet method such as (a) a suspension polymerization method, (b) an emulsion polymerization flocculation method or (c) a dissolution suspension method, are employed. Among (a), (b) and (c), when (b) the emulsion polymerization flocculation method is employed, coarse particles are likely to be formed via a flocculation step, and therefore, among the methods for producing toner host particles by wet methods, it is preferred to employ (b) the emulsion polymerization flocculation method from such a viewpoint that the effect of screening of the present invention will be distinct.

Now, the method for producing a toner for developing an electrostatic charge image of the present invention will be described in further detail with respect to each of (a) the suspension polymerization method, (b) the emulsion polymerization flocculation method and (c) the dissolution suspension method among the wet methods, sequentially in the order of (a), (c) and (b).

In a case where toner host particles in the present invention are to be produced by (a) the suspension polymerization method, a conventional method may be employed. Namely, usually, in an aqueous medium, a polymerizable monomer to constitute a binder resin, a suspension polymerization dispersing agent, a polymerization initiator, a colorant and, as optionally added, other components such as an electrification-controlling agent and wax, are suspended and dispersed to have a suitable particle diameter by means of a dispersing machine, and then the polymerizable monomer is polymerized to obtain toner host particles. The temperature for the polymerization is preferably from 30 to 200° C., more preferably from 60 to 100° C., and the pressure during the polymerization may be an elevated pressure, atmospheric pressure or reduced pressure. Further, the polymerization time is preferably from 1 to 15 hours, more preferably from 3 to 10 hours.

As the binder resin constituting the toner host particles by the suspension polymerization method, the above-mentioned styrene type resin may be employed, and as the polymerizable monomer, the same one as the polymerizable monomer to be used in the after-mentioned emulsion polymerization flocculation method may be used.

As the suspension polymerization dispersing agent, an inorganic powder insoluble or hardly insoluble in the aqueous medium may, for example, be used such as known calcium phosphate, talc, bentonite, silicic acid, diatomaceous earth, barium sulfate, aluminum hydroxide, calcium sulfate, barium carbonate, magnesium carbonate or calcium carbonate. Its amount is preferably from 0.5 to 5 parts by weight, more preferably from 1 to 3 parts by weight, per 100 parts by weight of the aqueous medium. The amount of the suspension polymerization dispersing agent is influential over the particle diameter distribution of the resin to be produced, and the larger the amount, the finer the particle diameter.

As the polymerization initiator, a known polymerization initiator may, for example, be used. As a specific example, a peroxide such as benzoyl peroxide, octanonyl peroxide, decanonyl peroxide, lauroryl peroxide or m-toluoyl peroxide, may suitably be used. The amount of the polymerization initiator is preferably from 0.5 to 10 parts by weight, based on the polymerizable monomer.

In a case where the toner host particles in the present invention are to be produced by (c) the dissolution suspension method, a conventional method may be employed. Namely, usually, in a solvent for a binder resin, the binder resin and a colorant, and, optionally, an electrification-controlling agent, a release agent, a magnetic material, etc., are dissolved or dispersed, and such a solution is mixed with a liquid having a low solubility for the binder resin to precipitate particles thereby to obtain toner host particles.

Now, the emulsion polymerization flocculation method which is particularly preferred in the present invention, will be described in detail.

In a case where toner host particles are produced by the emulsion polymerization flocculation method, the method usually has an emulsion polymerization step, a mixing step, a flocculation step and an aging step, but the respective steps may be overlapped. The toner for developing an electrostatic charge image of the present invention is preferably produced by a production process comprising a flocculation step wherein at least a dispersion of primary particles of the polymer obtained by an emulsion polymerization method and a dispersion of colorant particles are mixed, and particles in the dispersion are flocculated to form agglomerates of particles, an aging step wherein the agglomerates of particles are then heated and fused in the dispersion to form fine particles of a toner, and a screening step wherein the fine particles of the toner are then screened in the state of a dispersion.

Namely, the toner host particles of the present invention are preferably ones obtained by mixing at least a dispersion of primary particles of a polymer obtained by an emulsion polymerization method and a colorant particle dispersion, followed by flocculation of particles in the dispersion and then by heat-fusing. Specifically, it is preferred that a colorant and optionally, an electrification-controlling agent, wax, etc., are mixed to a dispersion containing primary particles of a polymer as a binder resin obtained by an emulsion polymerization, then primary particles in this dispersion are flocculated and aged to form agglomerates of particles having a volume average particle diameter of from about 3 to 8 μm, and then the obtained dispersion of toner host particles is screened, followed by washing and drying.

As the binder resin constituting primary particles of a polymer to be used in the emulsion polymerization flocculation method, the above-mentioned resin is employed. As the polymerizable monomer, it is preferred to use a polymerizable monomer having a polar group. Namely it is preferred to use a monomer having a Brønsted acidic group (hereinafter referred to simply as "acidic monomer") or a monomer having a Brønsted basic group (hereinafter referred to simply as "basic monomer"). Further, it is preferred to use a monomer having neither Brønsted acidic group or Brønsted basic group (hereinafter referred to simply as "another monomer") in combination as a raw material monomer. At that time, the respective monomers may be added separately, or a plurality of monomers may preliminarily be mixed and simultaneously added. Further, the polymerizable monomers may be added as they are, or they may be added in the form of an emulsion preliminarily prepared as mixed with e.g. water or an emulsifier, etc.

The acidic monomer is not particularly limited and may, for example, be a monomer having a carboxyl group such as acrylic acid, methacrylic acid, maleic acid, fumaric acid or cinnamic acid, a monomer having a sulfonic acid group such as styrene sulfonate, or a monomer having a sulfonamide group such as vinyl benzene sulfonamide. Further, the basic monomer is not particularly limited, and may, for example, be an aromatic vinyl compound having an amino group such as amino styrene, a nitrogen-containing hetero ring-containing monomer such as vinyl pyridine, vinyl pyrrolidone, or a (meth)acrylate having an amino group, such as dimethylaminoethyl acrylate or diethylaminoethyl methacrylate. Such acidic monomers and basic monomers may be used alone or in combination as a mixture of two or more of them, and they may be present in the form of salts having counter ions. Among them, it is preferred to use an acidic monomer, and acrylic acid and/or methacrylic acid is particularly preferred.

The total amount of polymerizable monomers having polar groups is preferably at least 0.05 part by weight, more preferably at least 0.5 part by weight, further preferably at least 1 part by weight, and preferably at most 10 parts by weight, more preferably at most 5 parts by weight, per 100 parts by weight of the total monomers constituting primary particles of a polymer as a binder.

Another monomer is not particularly limited and may, for example, be a styrene, such as a styrene, methylstyrene, chlorostyrene, dichlorostyrene, p-tert-butylstyrene, p-n-butylstyrene or p-n-nonylstyrene; an acrylate such as methyl acrylate, ethyl acrylate, propyl acrylate, n-butyl acrylate, isobutyl acrylate, hydroxyethyl acrylate or ethylhexyl acrylate; a methacrylate such as methyl methacrylate, ethyl methacrylate, propyl methacrylate, n-butyl methacrylate, isobutyl methacrylate, hydroxyethyl methacrylate or ethylhexyl methacrylate; or an acrylic acid amide such as acrylamide, N-propylacrylamide, N,N-dimethylacrylamide, N,N-dipropylacrylamide or N,N-dibutylacrylamide. Such another monomer may be used alone, or a plurality may be used in combination. Among them, styrene is particularly preferred.

Further, in a case where a cross-linked resin is employed as a binder resin constituting primary particles of the polymer, a polyfunctional monomer having radical polymerizability is used as a cross-linking agent used together with the above polymerizable monomer, and it may, for example, be divinyl benzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate. Otherwise, it is also possible to employ a monomer having a reactive group in the pendant group, such as glycidyl methacrylate, methylol acrylamide or acrolein. Among them, a radical polymerizable difunctional monomer is preferred, and divinyl benzene or hexadiol diacrylate is particularly preferred. Such polyfunctional monomers may be used alone or in combination as a mixture of two or more of them.

In a case where a cross-linked resin is employed as a binder resin constituting primary particles of the polymer, the blend ratio of the polyfunctional monomer occupying in all polymerizable monomers constituting the resin is preferably at least 0.005 mass %, more preferably at least 0.1 mass %, further preferably at least 0.3 mass % and preferably at most 5 mass %, more preferably at most 3 mass %, further preferably at most 1 mass %, to make the fixing property, high temperature off-set resistance, blocking property etc. to be good.

As the emulsifier to be used for the emulsion polymerization, a known one may be used, and one or more emulsifiers selected from cationic surfactants, anionic surfactants and nonionic surfactants may be used.

The cationic surfactants are not particularly limited and may, for example, be dodecylammonium chloride, dodecylammonium bromide, dodecyltrimethylammonium bromide, dodecylpyridinium chloride, dodecylpyridinium bromide and hexadecyltrimethylammonium bromide. The anionic surfactants may, for example, be a fatty acid soap such as sodium stearate or sodium dodecanoate, sodium dodecyl sulfate, sodium dodecylbenzenesulfonate and sodium laurylsulfate. The nonionic surfactants may, for example, be polyoxyethylene dodecyl ether, polyoxyethylene hexadecyl ether, polyoxyethylene nonyl phenyl ether, polyoxyethylene lauryl ether, polyoxyethylene sorbitan monooleate ether and monodecanoyl sucrose.

The amount of the emulsifying agent is usually from 0.1 to 10 parts by weight per 100 parts by weight of the polymerizable monomer. Further, to such an emulsifying agent, one or more polyvinyl alcohols such as partially or completely saponified polyvinyl alcohols, or cellulose derivatives such as hydroxyethyl cellulose, may be used in combination as a protective colloid.

As a polymerization initiator, one or more of hydrogen peroxide; a persulfate such as potassium persulfate; an organic peroxide such as benzoyl peroxide or lauroyl peroxide; and an azo compound such as 2,2'-azobisisobutyroyl or 2,2'-azobis(2,4-dimethylvaleronitrile), may, for example, be used usually in an amount of from 0.1 to 3 parts by weight per 100 parts by weight of the polymerizable monomer. Further, redox initiator may be made by using such a polymerization initiator in combination with one or more reducing agents, such as reducing organic compounds such as ascorbic acid, tartaric acid and citric acid, and reducing inorganic compounds such as sodium bisulfite and sodium metabisulfite. Among them, hydrogen peroxide, an organic peroxide or an azo compound is preferred as the initiator.

Further, one or more suspension stabilizers such as potassium phosphate, magnesium phosphate, calcium hydroxide and magnesium hydroxide may be used in an amount of from 1 to 10 parts by weight per 100 parts by weight of the polymerizable monomer. Each of the above polymerization initiator and the suspension stabilizer may be added to the polymerization system at any timing of before, at the same time as or after the addition of the polymerizable monomer, and if necessary, such addition methods may be used in combination.

At the time of emulsion polymerization, a known chain transfer agent may be used as the case requires. Such a chain transfer agent is not particularly limited, but specifically, it may, for example, be t-dodecyl mercaptan, 2-mercaptoethanol, diisopropylxanthogene, carbon tetrachloride or trichlorobromomethane. Such chain transfer agents may be used alone or in combination as a mixture of two or more of them. Such a chain transfer agent is employed usually within a range of at most 5 mass %, based on the entire polymerizable monomers.

Further, to the reaction system, a pH-controlling agent, a polymerization degree-controlling agent, a defoaming agent, etc. may further be suitable added as the case requires.

In the emulsion polymerization, the above polymerizable monomers are polymerized in the presence of the polymerization initiator, and the polymerization temperature is usually from 50 to 120° C., preferably from 60 to 100° C., further preferably from 70 to 90° C., and the pressure during the polymerization may be elevated pressure, atmospheric pressure or reduced pressure.

The volume average particle diameter of primary particles of the polymer obtained by the emulsion polymerization is desired to be usually at least 0.02 μm, preferably at least 0.05 μm, further preferably at least 0.1 μm and usually at most 3 μm, preferably at most 1 μm, further preferably at most 0.5 μm. If the particle diameter is less than 0.02 μm, it tends to be difficult to control the flocculation rate in the flocculation step, and if it exceeds 3 μm, the particle diameter of the toner obtainable by flocculation tends to be large, and it tends to be difficult to obtain a toner having the desired particle diameter.

In the production method of the present invention, a resin obtained by a polymerization method different from emulsion polymerization may be used in combination as primary particles of a polymer. With respect to such a resin, it is desired to employ one having a volume average particle diameter of usually at least 0.02 μm, preferably at least 0.05 μm, further preferably at least 0.1 μm, and usually at most 3 μm, preferably at most 2 μm, further preferably at most 1 μm.

A method for incorporating a colorant in the emulsion polymerization flocculation method is not particularly limited, but it is preferred that a dispersion of primary particles of the polymer and a dispersion of colorant particles are mixed to obtain a mixed dispersion, and then, this mixed dispersion is flocculated to obtain agglomerates of particles. The colorant is particularly preferably used in a state emulsified in water in the presence of an emulsifier, and the volume average particle diameter of the colorant particles is preferably from 0.01 to 3 μm.

The method for incorporating wax in the emulsion polymerization flocculation method is not particularly limited, but a wax emulsion preliminarily emulsified and dispersed in water to have a volume average particle diameter of from 0.01 to 2.0 μm, more preferably from 0.01 to 0.5 μm, may be added during the emulsion polymerization or may be added in the flocculation step. In order to let wax be dispersed with a suitable dispersed particle diameter in the toner, it is preferred to add wax as a seed during the emulsion polymerization. When it is added as a seed, the wax will be finely and uniformly dispersed in the toner, whereby it is possible to suppress deterioration of the electrification property or heat resistance of the toner.

In a case where an electrification-controlling agent is incorporated to the toner in the emulsion polymerization flocculation method, a method for its incorporation is not particularly limited, and may be a method wherein the electrification-controlling agent is added together with monomers, etc. at the time of emulsion polymerization, or it is added in the flocculation step together with primary particles of the polymer, the colorant, etc., or it is added after primary particles of the polymer, the colorant, etc. are flocculated to a substantially proper particle diameter as a toner. Among them, it is particularly preferred to employ a method wherein the electrification-controlling agent is emulsified and dispersed in water by using an emulsifier, and the dispersion is added in the flocculation step. The volume average particle diameter of the electrification-controlling agent in such a case, is preferably from 0.01 to 3 μm.

The above-mentioned volume average particle diameters of the primary particles of the polymer, the dispersed particles of the colorant, the dispersed particles of the wax, the dispersed particles of the electrification-controlling agent, etc., are ones measured by using Microtrac UPA (manufactured by Nikkiso Co., Ltd.).

In the flocculation step in the emulsion polymerization flocculation method, the above-mentioned blend components such as the primary particles of the polymer, the colorant particles, and the optional electrification-controlling agent, wax, etc., may be mixed simultaneously or sequentially. However, it is preferred that dispersions of the respective components, i.e. a dispersion of the primary particles of the polymer, a dispersion of the colorant particles and optionally a dispersion of the electrification-controlling agent, a dispersion of fine particles of wax, are preliminarily prepared, and they are mixed to obtain a mixed dispersion, from the viewpoint of the uniformity of the composition and the uniformity of the particle diameters.

The above flocculation treatment is carried out usually by a method of heating in an agitation tank, a method of adding an electrolyte or a combination of such methods. When the primary particles are flocculated with stirring to obtain agglomerates of particles close to the size of the toner, the particle diameter of the agglomerates of particles may be controlled by the balance between the flocculation force of the particles to one another and the shearing force by stirring, but the flocculation force can be increased by the heating or the addition of an electrolyte.

In a case where flocculation is carried out by adding an electrolyte, the electrolyte is not particularly limited and may be an organic salt or an inorganic salt. Specifically, it may, for example, be NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ or $C_6H_5SO_3Na$.

The amount of the electrolyte varies depending upon the type of the electrolyte, the particle diameter of the desired toner host particles, etc., but it is usually from 0.05 to 25 parts by weight, preferably from 0.1 to parts by weight, more preferably from 0.1 to 10 parts by weight, per 100 parts by weight of the solid component in the mixed dispersion. If the amount is less than 0.05 part by weight, the progress of the flocculation reaction tends to be slow, and there may be a case where a problem will result such that a fine powder of at most 1 μm will remain even after the flocculation reaction, or the average particle diameter of the obtained agglomerates of particles tends not to reach the desired particle diameter. If it exceeds 25 parts by weight, flocculation tends to be rapid, and it tends to be difficult to control the particle diameter, thus leading to a problem such that coarse particles or irregular ones are contained in the obtained agglomerated particles. When flocculation is carried out by an addition of the electrolyte, the flocculation temperature is not particularly limited, but it is preferably from 20 to 70° C., more preferably from 30 to 60° C.

In a case where the flocculation is carried out only by heating without using an electrolyte, the flocculation temperature is not particularly limited, but it is preferably within a temperature range of from ($Tg_1$-20° C.) to $Tg_1$, particularly preferably within a range of from ($Tg_1$-10° C.) to ($Tg_1$-5° C.), wherein $Tg_1$ is Tg of the primary particles of the polymer.

The time required for the flocculation is optimized depending upon the shape of the device or the treatment scale, but in order to let the particle diameter of the toner particles reach the desired particle diameter, it is advisable to maintain the flocculation temperature at the above prescribed temperature for at least 30 minutes. The temperature rise to the prescribed temperature may be constant or stepwise.

In the present invention, on the surface of the agglomerates of particles after the above flocculation treatment, fine particles of a resin may be coated (deposited or fixed) as the case requires, to form toner host particles. By covering the surface of the agglomerates of particles with fine particles of a resin, it may be possible to improve the electrostatic property or heat resistance. The volume average particle diameter of such fine particles of a resin is preferably from 0.02 to 3 μm, more preferably from 0.05 to 1.5 μm. As such fine particles of a resin, ones obtained by polymerizing a monomer similar to the monomer employed for the above-mentioned primary particles of the polymer, may be employed. Among them, a cross-linked resin containing a polyfunctional monomer as a starting material is preferred, and it preferably has Tg higher than Tg of the primary particles of the polymer, particularly preferably Tg higher by at least 5° C.

Such fine particles of a resin are used usually in the form of a dispersion as dispersed in water or a liquid composed mainly of water by means of an emulsifier. In a case where the above-mentioned electrification-controlling agent is added after the flocculation treatment, it is preferred that the fine particles of a resin are added after the electrification-controlling agent is added to a dispersion containing the agglomerates of particles.

In the emulsion polymerization flocculation method, it is preferred to add an aging step to induce fusion among the flocculated particles in order to increase the stability of the agglomerates of particles obtained by the flocculation. The temperature for such an aging step is preferably at least Tg of the binder resin constituting the primary particles, more preferably at least a temperature higher by 5° C. than such Tg and preferably at most a temperature higher by 80° C. than such Tg, more preferably at most a temperature higher by 50° C. than such Tg. Further, the time required for the aging step varies depending upon the shape of the desired toner, but it is preferred to maintain the temperature for from 0.1 to 10 hours, more preferably from 1 to 6 hours, after the temperature has reached at least Tg of the binder resin constituting the primary particles.

Further, in the emulsion polymerization flocculation method, it is preferred to add an emulsifier or to increase the pH value of the flocculation liquid after the above flocculation step preferably before the aging the step or during the aging step. As the emulsifier to be used here, at least one of emulsifiers useful for the production of the above-mentioned primary particles of the polymer may be selected for use, but it is particularly preferred to employ the same emulsifier as the one used for the production of the primary particles of the polymer. When the emulsifier is added, its amount is not particularly limited, but it is preferably at least 0.1 part by weight, more preferably at least 1 part by weight, further preferably at least 3 parts by weight and preferably at most 20 parts by weight, more preferably at most 15 parts by weight, further preferably at most 10 parts by weight, per 100 parts by weight of the solid component in the mixed dispersion. By adding an emulsifier or by increasing the pH value of the flocculation liquid after the flocculation step and before the completion of the aging step, it is possible to suppress e.g. agglomeration of agglomerates of particles flocculated in the flocculation step, thereby to suppress formation of coarse particles in the toner host particles after the aging step.

By such heat treatment, fusion and unification of primary particles to one another take place in the agglomerates, whereby the shape of the toner particles as the agglomerates tends to be spherical. Agglomerates of particles before the aging step are considered to be gathering of primary particles by electrostatic or physical flocculation, but after the aging step, the primary particles of the polymer constituting the agglomerates of particles are fused one another, and it becomes possible to bring the shape of particles close to a spherical shape. By such an aging step, by controlling e.g. the temperature and time of the aging step, it is possible to produce toners having various shapes depending upon the particular purpose, such as a grape type of shape wherein the primary particles are flocculated, a potato type wherein the fusion is advanced and a spherical shape wherein the fusion is further advanced.

By further forming on the surface of the above-mentioned particles an outer layer composed mainly of a polymer preferably in a thickness of from 0.01 to 0.5 μm, the toner for developing an electrostatic charge image in the present invention may be formed in capsulated toner host particles. Tg of the above-mentioned outer layer polymer in the capsulated toner particles is preferably from 70 to 110° C. and preferably higher than Tg of the polymer constituting the above-mentioned agglomerated (aged) particles.

The method of the present invention has a feature in the step of screening the toner host particles thus formed, and specifically, it has a feature such that the screening step has a step of screening a dispersion of toner host particles.

Further, the present invention provides a method for producing a toner for developing an electrostatic charge image, which comprises a step of screening a dispersion of toner host particles by a screen, characterized in that when the above step is carried out, the following formula (1) is satisfied:

$$Y \leqq \{1/(M^2+r^2+2Mr)\} \times 10^8 \times 0.6 \quad (1)$$

where Y is the number of particles (number/cm$^2$) existing on the screen and having sizes of at least the mesh size of the screen, and M is the mesh size (μm) of the screen, and r is the diameter (μm) of wire constituting the screen.

The right-hand side in the above formula (1) represents a 60% value of numerical apertures on the screen per unit area (number/cm$^2$) where M is the mesh size (μm) of the screen and r is the diameter (μm) of wire constituting the screen. And, if Y i.e. the number of particles (number/cm$^2$) existing of the screen and having sizes of at least the mesh size of the screen, is smaller than the right-hand side, screening of the dispersion of toner host particles can be continued without clogging of the mesh. In theory, when all mesh is clogged, i.e. when Y becomes equal to $\{1/(M^2+r^2+2Mr)\} \times 10^8$, the dispersion of toner host particles becomes unable to pass through the screen and will overflow. However, in reality, when the mesh of the screen is clogged to a certain degree, the feeding amount exceeds the amount passing through the screen, and the overflow starts when clogging has reached a level of 60%. Strictly speaking, the degree of clogging for such overflow changes depending upon the feeding amount, the is feeding rate or the feeding method of the dispersion of toner host particles, but in the method for producing a toner for developing an electrostatic charge image, a degree of clogging of about 60% is the upper limit from the viewpoint of the production efficiency. And, such a value is preferably at most 50%, more preferably at most 40%, further preferably at most 30%. The smaller the value, the better. However, from the industrial viewpoint, the lower limit is 0.01%. The present invention is an invention to screen a dispersion of toner host particles while satisfying the above formula (1), whereby screening can be carried out continuously without overflowing from the screen.

Thus, toner host particles are produced, and a dispersion of such toner host particles is screened, whereby a toner for developing an electrostatic charge image can be produced efficiently in good yield.

Further, in the method for producing a toner for developing an electrostatic charge image of the present invention, the screen to be used in the step of screening the dispersion of toner host particles is not particularly limited. However, in order to prevent clogging with particles having a particle diameter close to the mesh size or with particles corresponding to the mesh size, it is preferred to carry out screening by exerting specific vibration to the screen to let the screen form dynamically waving wrinkles thereby to change the mesh opening shape to release particles stuck on the surface of the screen, or by exerting vibration to the screen to let the dispersion of the toner host particles move outwardly from the center of the screen. Such movement is particularly preferably swirling movement.

In the method for producing a toner for developing an electrostatic charge image of the present invention, it is preferred to use a screen device provided with a screen, as defined in the following 1, 2 or 3.

1. A screen device characterized in that the screen is one wherein the shape of the minimum opening unit of the screen to let particles pass therethrough, changes from the stationary state by vibration during the screening step.

2. A screen device characterized in that the screen is one to which substantially no tension is applied.

3. A screen device characterized in that the screen is made of, as the main material, a material having a Young's modulus of at most 100 GPa, and the area ($S_2$) of the screen when the screen existing in the fixed portion of the screen is spread flatly, is larger than the area ($S_1$) of the opening for screening in the fixed portion of the screen.

Now, the screen devices of the present invention as defined in the above 1 to 3 which are capable of preventing clogging of the screen, will be described in detail in this order.

The screen device of 1 is a screen device characterized in that the shape of the minimum opening unit of the screen to let particles pass therethrough, changes from the stationary state during the screening operation. Clogging of the screen means a state where particles are stuck in substantially fixed mesh openings so that the particles are not released. By the screen device of the above 1, the shape of the mesh openings of the screen changes during the screening operation from the stationary state, whereby stuck-particles may pass through or released on the screen surface, whereby continuous operation will be possible. In the method for producing a toner for developing an electrostatic charge image, it is preferred to have stuck-particles released on the screen surface.

The method of letting the shape of the minimum opening unit change during the screening operation may, for example, be a method of changing the nature of the material by e.g. the temperature or a method of vibrating the screen for deformation. For the method of changing the nature of the material by e.g. the temperature, an elastic modulus variable material (e.g. JP-A-7-097526) or the like may be used. Whereas, for the method for vibrating the screen for deformation, the screen may suitably be installed so that vibration will induce a change in the shape of the screen.

The screen device of 2 is a screen device wherein substantially no tension is applied to the screen. Usually, in a screen device, a screen net is assembled while the tension is adjusted at the time of fixing, so that the tension of the screen net will be uniform to avoid irregularity in tension (e.g. JP-A-5-068946, JP-A-200-343038). To the contrary, the screen device of the above 2 is characterized in that no tension is applied. When a tension is applied, the mesh will be uniform, and the screening ability will be improved, but the mesh openings of the screen (the shapes of the minimum opening units of the screen) will not change, whereby clogging is likely to result. Contrary to the prior art, according to the present invention, the screen is installed to be relaxed without applying a tension to the screen, whereby the shape of the mesh openings is permitted to change so that clogging can be prevented. Further, such a construction is effective also for prevention of breakage of the screen.

The screen device of 3 is a screen device characterized in that the screen is made of, as the main material, a material having a Young's modulus of at most 100 GPa, and the area (hereinafter referred to as "$S_2$") of the screen when the screen existing in the fixed portion in the screen is spread flatly, is larger than the area (hereinafter referred to as "$S_1$") of the opening for screening of the fixed portion of the screen. When $S_2$ is larger than $S_1$, the shape of mesh openings may be changed in the same manner as the screen device of 2 so that clogging can be prevented. $S_2$ is preferably larger than $S_1$ within a range of from 1.000001 to 5 times, particularly preferably within a range of from 1.000001 to 3 times. Within the above range, overlapping of the screen itself will not be so large that the screening can be carried out without lowering the screening ability.

Further, according to the screen device of 3, the shape of the mesh openings may be made to be changed by using a screen made of, as the main material, a material having a Young's modulus of at most 100 GPa. On the other hand, if the Young's modulus exceeds 100 GPa, even if the relation of $S_1<S_2$ is satisfied, it is not effectively possible to change the shape of the mesh openings, and clogging may sometimes be induced.

Further, when the screen is hauled up in its stationary state without exerting any tension other than its own weight, the angle of the hauled up screen to the horizontal direction of the fixed portion of the screen preferably exceeds 0 degree, particularly preferably at least 0.1 degree, further preferably at least 0.5 degree, still further preferably at least 1 degree. The upper limit value is preferably at most 60 degrees, more preferably at most 50 degrees. Within such a range, overlapping of the screen itself would not be so much that the screening can be carried out without lowering the screening ability.

Further, when the screen is hauled up in its stationary state without exerting any tension, the maximum height (hereinafter referred to as "the maximum sagging height") when a perpendicular line is taken from the apex of the screen to the horizontal direction of the fixed portion of the screen, is preferably at least 1/1,000, further preferably at least 1/500, particularly preferably at least 1/100, of the maximum diameter of the screen. Its upper limit value is not particularly limited, but it is preferably at most the maximum diameter of the screen, further preferably at most ½ of the maximum diameter of the screen.

In the present invention, a wet screen is employed. The wet screen in the present invention means a screen which is capable of separating, by screening the dispersion, particles capable of passing therethrough and particles incapable of passing therethrough. In the present invention, the liquid constituting the dispersion is not limited, and it may be water, an organic liquid, or a mixed liquid or suspension thereof. However, an aqueous dispersion of toner host particles formed by the above-mentioned wet method may preferably be employed as it is, before separation of toner host particles.

In the method of the present invention, the screen is used as being vibrated. The vibration method is not particularly limited, and the vibration may be not only mechanical vibration but also imparted by ultrasonic waves. It is preferred that the screen is used as being vibrated, whereby the screening efficiency will be improved, and at the same time, clogging of the screen may be prevented. It is particularly preferred that the vibration is mechanical vibration, whereby the above effects can be obtained more distinctly.

In the present invention, it is preferred to carry out screening while letting the dispersion of toner host particles move outwardly from the center of the screen in a swirling fashion. Namely, it is preferred to exert vibration to the screen so that the dispersion of the toner host particles will move as described above. The swirling is preferably made to prolong the retention time of the dispersion on the screen as long as possible.

Further, in the present invention, it is preferred to exert vibration to the screen during the screening step to let the screen form dynamically waving wrinkles. Further, the screen is preferably made of a material such that dynamically waving wrinkles may be formed when vibration is exerted to the screen in the screening step. By such dynamically waving wrinkles, the shape of the mesh openings will be changed, whereby stuck-particles will be lifted on the screen surface and removed.

Further, such vibration is preferably one generated by rotation of eccentric weights, whereby the above-mentioned screening effects can be obtained more distinctly. Further, such a method is preferred also in that vibration having the above-mentioned nature of swirling movement can readily be obtainable. Hereinafter, the system of imparting such vibration to the screen will be referred to as "the eccentric weight system".

The eccentric weight system is preferably one wherein the vibration of the screen is obtained by rotation of a motor having a rotational axis common with the center axis of the screen and such vibration is obtained by at least two eccentric weights fixed to the rotational axis so that their center of gravity is displaced from the rotational axis.

An apparatus to vibrate a screen by means of an eccentric weight system may, for example, be a Sato-type vibrating screen device manufactured by Koei Sangyo Co., Ltd., a bottom center drop type vibrating screen device, a vibrating screen device provided with disintegrating mechanism or a high vibration type vibrating screen device.

Among eccentric weight systems, preferred is one wherein two eccentric weights are used, and they are fixed to the rotational axis so that the twisting angle (hereinafter referred to as "the phase angle") between "a linear line connecting the point at which the first weight is fixed to the rotational axis and the center of gravity of the first weight" and "the linear line connecting the point at which the second weight is fixed on the rotational axis and the center of gravity of the second weight" will be within a specific range. Further, the two eccentric weights are preferably fixed in the planes perpendicular, respectively, to the rotational axis.

The phase angle is desired to be at least 5°, preferably at least 10°, more preferably at least 15° and at most 30°, preferably at most 25°, more preferably at most 20°. If the phase angle in the screening operation is less than 5°, the toner host particles to be screened tend to move linearly from the center of the screen towards the outer peripheral direction (the radius of curvature being large), whereby particles which should be the minus sieve product, are likely to be discharged together with coarse particles, thus leading to a yield loss, and the screening efficiency is likely to decrease. On the other hand, if the phase angle exceeds 30°, the toner host particles to be screened tend to move from the periphery towards the center (the radius of curvature being too small or nil), whereby the coarse particles will not be discharged out of the device, thus leading to clogging, and the screening efficiency is likely to decrease. When the phase angle is within the above range, toner host particles to be screened tend to undergo swirling motion from the center towards the periphery on the screen, whereby uniform and highly precise screening will be possible, and clogging tends to scarcely occur.

The form of the screen is not particularly limited, and it may, for example, be a screen of orthogonal mesh, oblique mesh, meandering mesh or honeycomb mesh, or one having a structure constituting three-dimensional spaces such as a non-woven fabric, and further, any material may be used so long as it has a screening function whereby coarse particles are not substantially permitted to pass therethrough such as a porous material or hollow fiber. Among them, it is preferred to use a screen with a mesh structure (hereinafter referred to simply as "a mesh screen"), since the screening efficiency is thereby good.

The outer shape of the screen body is also not particularly limited. However, in the case of a mesh screen, the outer shape is preferably circular from the viewpoint of the screening efficiency. Further, the screening operation may be carried out in one step or multi steps. In a case where coarse particles are present in a large amount, it is preferred to install screens having different mesh sizes in a multistage structure.

In the present invention, the mesh size of the screen is not particularly limited, but it is preferably at least 10 μm, more preferably at least 15 μm, further preferably at least 20 μm. If the mesh size of the screen is too small, there may be a case where it becomes difficult to efficiently obtain a toner having a desired particle diameter due to deterioration of the yield, and clogging of the screen tends to occur. On the other hand, the mesh size of the screen is preferably at most 50 μm, more preferably at most 40 μm, further preferably at most 30 μm. If the mesh size of the screen is too large, the probability that coarse particles will pass therethrough to the minus sieve side, will increase, and it tends to be difficult to efficiently remove coarse particles, such being undesirable from the viewpoint of the product quality. Here, the mesh size of the screen means the space distance between the materials constituting the mesh.

In the present invention, the material of the screen is not particularly limited, and it may, for example, be a resin such as a polyester, a polypropylene, a polyamide or an acrylic resin; a natural fiber such as a cotton cloth; or a metal such as stainless steel. Among them, one made of an acid resistant resin, particularly one made of a polyester resin, is preferred, since durability against bending can be maintained even if it is used for a long time.

Further, when it is represented by a Young's modulus, one constituted mainly of a material having a Young's modulus of at most 100 GPa as the upper limit is preferred, and the upper limit is particularly preferably 50 GPa, further preferably 10 GPa. On the other hand, the lower limit is at least 0 GPa, particularly preferably at least 3.0 GPa. Within such a range, the durability against bending, and the balance in the change when the shape of the mesh openings of the screen is changed by vibration will be particularly excellent.

Further, in a case where the screen is constructed by weaving a filament, the diameter of such a filament is, as the lower limit value, preferably at least 10 μm, more preferably at least 20 μm, further preferably at least 25 μm, and, as the upper limit value, preferably at most 100 μm, more preferably at most 80 μm, further preferably at most 70 μm. Further, even in a case where the screen is not constructed by weaving a filament, the thickness of the screen is preferably within the above range. When the Young's modulus and/or filament diameter is within the above range, it tends to be easy to let the screen form dynamically waving wrinkles, the durability against bending tends to be easily obtainable, and the shape of mesh openings of the screen i.e. the shape of the minimum opening units of the screen may easily be changed by vibration.

Further, in the screen device of the present invention, the screen installed there is preferably supported by a screen to support such a screen (hereinafter referred to as "a support screen") so that the screen will not sag downwardly. The support screen may have a strength of such a level that the screen will not sag, and in order to prevent breakage of the screen and to carry out uniform screening, it is preferred to support the screen with a support screen having a shape not influential over screening i.e. having a mesh size larger than the screen. It is also preferred that a screen of a commercially available vibration screen device is used as the support screen, and the above screen is set thereon. By the presence of such a support screen, dynamically waving wrinkles may be formed more effectively. Further, it is possible to use, as a support screen, a screen made mainly of a material having a Young's modulus exceeding 100 GPa or a screen using a punching plate of a thick resin. Among them, it is preferred to employ, as a support screen, a screen made of a material having a Young's modulus exceeding 100 GPa as the main material.

The dispersion of the toner host particles to be subjected to the screening step preferably contains a predetermined amount of an emulsifier or a suspension stabilizer, and the emulsifier or the suspension stabilizer is preferably contained in an amount of at least 0.1 mass %, more preferably at least 0.5 mass %, based on the entire dispersion. If the content of the emulsifier or the suspension stabilizer is too small, toner host particles in the screening step tend to agglomerate, and clogging of the screen tends to be accelerated, such being undesirable. The upper limit for the content of the emulsifier or the suspension stabilizer is not particularly limited, but it is preferably at most 5 mass %, more preferably at most 2 mass %.

The concentration of toner host particles in the entire dispersion to be subjected to the screening step is, as the lower limit value, preferably at least 5 mass %, more preferably at least 10 mass % and, as the upper limit value, preferably at most 30 mass %, more preferably at most 20 mass %. When the concentration of toner host particles in the dispersion is within such a range, screening can be carried out efficiently without clogging of the screen, such being desirable.

Toner host particles thus screened in a dispersed state preferably has a volume fraction of particles having a particle diameter of at least 25 μm as measured by Coulter counter being preferably at most 1%, more preferably at most 0.5%, further preferably at most 0.1%, particularly preferably at most 0.05%. It is most preferred that no coarse particles having a particle diameter of at least 25 μm be present at all, but from the industrial viewpoint, the lower limit value is 0.01%. Further, the volume fraction of particles having at least 15 μm is preferably at most 2%, more preferably at most 1%, further preferably at most 0.1%. It is also most preferred that no coarse particles having a particle diameter of at least 15 μm be present, but from the industrial viewpoint, the lower limit value is 0.0001%. This means that the coarse particles are less than the predetermined amount. According to the present invention, it is possible to produce toner host particles containing little coarse particles, whereby consumption of the toner is less during continuous development, and the image tends to be stabilized. Further, there will be no image defects such as white spots, white streaks or scattering of the toner.

As described above, by screening toner host particles formed by a wet method, in a dispersed state, it is possible to efficiently remove coarse particles. As compared with the after-mentioned method of screening and classifying a toner obtained after the auxiliary agent addition step by means of an apparatus such as a dry system screen or an air screen classifier, by preliminarily screening the toner host particles in a dispersed state, it becomes possible to reduce the amount of a toner which is regarded as a non-standard product, and at the same time, it becomes possible to prevent clogging of the filter at the time of washing. Further, when the toner host particles are preliminarily screened in a dispersed state, in the case of toner host particles agglomerated by a weak flocculation force, they may be disintegrated in the suspension. Such effects will be made more remarkable by vibrating the screen. Further, if it is attempted to disintegrate agglomerated toner host particles after drying, an installation for such a disintegration step will be required, whereby the production efficiency deteriorates, and the desired toner host particles may sometimes be crushed. By the method of the present invention, only the undesired coarse particles can be efficiently removed without bringing about such troubles.

The production method of the present invention may have a washing step for washing the toner host particles obtained by the wet method. As the liquid to be used for such washing, the water in which the toner is immersed in the final step in e.g. (a) a suspension polymerization method, (b) an emulsion polymerization flocculation method or (c) a dissolution suspension method, may simply be replaced with water having a higher purity. However, washing can be carried out with a liquid of an acid or alkali or an aqueous solution thereof. Specifically, it is possible to employ, for example, an inorganic acid such as nitric acid, hydrochloric acid or sulfuric acid, or an organic acid such as citric acid. Further, the washing can be carried out not only at room temperature but also under heating, or such methods may be used in combination. Such a washing step is preferred, since it is thereby possible to remove or reduce a suspension stabilizer, an emulsifier, a solvent, an unreacted remaining monomer, a toner having a particle diameter smaller than the desired size. In such a washing step, it is preferred that the liquid to be washed is subjected to e.g. filtration or decantation to concentrate the toner host particles or to form a wet cake, and a liquid for washing is added afresh thereto to disperse the toner host particles, and such an operation is repeated. Further, the toner host particles after the washing are preferably recovered in the form of a wet cake, from the viewpoint of the handling efficiency in the subsequent drying step.

In the production method of the present invention, the above-described washing step may be carried out before or after the step of screening the dispersion, but is preferably carried out after the screening step. In a case where washing is carried out before the step of screening the dispersion i.e. before the step of removing coarse particles, there may be a case where clogging of the filter material occurs during the washing. Further, there may be a case where agglomeration of toner host particles will be promoted, since the content of the suspension stabilizer or emulsifier will decrease by the washing.

The volume average particle diameter of the toner host particles thus washed and dried is preferably within a range of from 3 to 15 μm, more preferably from 5 to 10 μm.

With respect to the shape of the toner host particles, the 50% circularity measured by using the flow type particle image analyzer PFIA-2000 is preferably at least 0.90, more preferably at least 0.92, further preferably at least 0.94. If the 50% circularity is less than 0.90, there may be a case where due to deterioration of the electrification by deposition area of the auxiliary agent, the image density tends to be low. Further, such a 50% circularity is preferably at most 0.98. If the 50% circularity exceeds 0.98, cleaning failure may result.

Further, Tg of the toner host particles by a DSC method is preferably at least 40° C., more preferably at least 5° C., and preferably at most 80° C., more preferably at most 70° C. When Tg is within the above range, the storage stability and the fixing property of the toner will be good, such being desirable. Here, in a case where Tg of the toner host particles cannot clearly be judged because of an overlapping with a calorie change based on another component, such as the fusion peak of wax, it means Tg when a toner is prepared in a state excluding such another component.

In the method for producing a toner for developing an electrostatic charge image of the present invention, a known auxiliary agent such as fine solid particles may be added to the surface of toner host particles in order to control the flowability or the developing property.

The fine solid particles as the auxiliary agent to be used in the present invention, may be suitably selected for use among various inorganic or organic fine particles. As the inorganic fine particles, various carbides such as silicon carbide, boron carbide, titanium carbide, zirconium carbide, hafnium carbide, vanadium carbide, tantalum carbide, niobium carbide, tungsten carbide, chromium carbide, molybdenum carbide, and calcium carbide; various nitrides such as boron nitride, titanium nitride, zirconium nitride and silicon nitride, various borides such as zirconium boride, various oxides such as titanium oxide, calcium oxide, magnesium oxide, zinc oxide, zirconium oxide, copper oxide, aluminum oxide, cerium oxide, silica and colloidal silica; various titanate compounds such as calcium titanate, magnesium titanate, strontium titanate and barium titanate; a phosphate compound such as calcium phosphate; a sulfide such as molybdenum disulfide; fluorides such as magnesium fluoride and carbon fluoride; various metal soaps such as aluminum stearate, calcium stearate, zinc stearate and magnesium stearate; talc; hydrotalcite; talcum; bentonite; various carbon blacks or conductive carbon blacks; magnetite; and ferrite, may, for example, be used. As the organic fine particles, fine particles of a styrene resin, an acrylic resin, an epoxy resin or a melamine resin may be employed. Further, as the fine solid particles, it is also possible to use ones having the above inorganic or organic fine particles subjected to surface treatment for e.g. hydrophobicity with a treating agent such as a silane coupling agent, a titanate type coupling agent, silicone oil, modified silicone oil, silicone varnish, a fluorine-type silane coupling agent, a fluorine-type silicone oil, or a coupling agent having an amino group or a quaternary ammonium salt group, and such treating agents may be used in combination as a mixture of two or more of them.

Among such fine solid particles, silica, titanium oxide, alumina, zinc oxide, various carbon blacks or conductive carbon blacks, may, for example, be particularly preferably used, and hydrophobic silica is particularly preferred.

Further, the above-mentioned fine solid particles may be used in combination as a mixture of two or more different types, and it is also possible to use surface treated ones and non-surface treated ones in combination. Or, it is possible to use ones differently surface treated, in combination. Further, it is possible to use positively charged ones and negatively charged ones in proper combination. Further, the above-mentioned electrification-controlling agent may be used as an auxiliary agent.

The average primary particle diameter of the fine solid particles is usually at least 1 nm, preferably at least 5 nm, more preferably at least 10 nm and usually at most 500 nm, preferably at most 100 nm, more preferably at most 50 nm. Further, within the above particle diameter range, ones having different particle diameters may be used in combination. The average particle diameter of the fine solid particles may be obtained by electron microscopic observation or may be calculated from the specific surface area by a BET method.

The amount of the fine solid particles is preferably at least 0.01 part by weight, more preferably at least 0.1 part by weight, further preferably at least 0.5 part by weight, and preferably at most 6 parts by weight, more preferably at most 5 parts by weight, further preferably at most 4 parts by weight. If the amount is less than the above range, when it is used as a toner for developing an electrostatic charge image, its flowability tends to be poor, thus leading to failure in toner consumption. On the other hand, if it exceeds the above range, there may be a case where due to filming, the image quality will be poor, or white spots will form.

In the present invention, there is no particular restriction with respect to the apparatus or the mixing conditions when the auxiliary agent is added to the surface of the toner host particles. The mixing machine to be used for the step of adding the auxiliary agent may, for example, be a Henschel mixer, a super mixer, a Nauta mixer, a V-type mixer, a double cone mixer or a drum-type mixer. Among them, a high speed stirring type mixer such as a Henschel mixer or a super mixer is preferred.

Further, as a method for adding an auxiliary agent, fixing treatment may also be carried out by means of an apparatus capable of exerting a compression shear stress (hereinafter referred to as a compression shear treatment apparatus) or an apparatus capable of melting or softening the surface of the toner host particles (hereinafter referred to as a particle surface-melt treating apparatus). By using such fixing treatment in combination with the above-mentioned mixing and drying step, fine solid particles will be firmly fixed to the surface of the toner host particles without substantial crushing of the toner host particles, whereby blocking resistance during storage at a high temperature will be improved, and it will be possible to produce a toner which is less susceptible to fusion to a copying machine/printer component even during continuous printing.

The above-mentioned compression shear treatment apparatus usually has a narrow space portion constituted by a head surface and a head surface, a head surface and a wall surface, or a wall surface and a wall surface, which are relatively moving while maintaining a distance, and particles to be treated are forced to pass through the space portion so that a compression stress and a shear stress may be exerted to the surface of particles with substantially no crushing. As such an apparatus, Mechanofusion apparatus manufactured by Hosokawa Micron Corporation may, for example, be mentioned. Whereas, the above-mentioned particle surface melt-treating apparatus is usually constructed so that a mixture of fine host particles and fine auxiliary particles is instantaneously heated to a level of at least the melt initiation temperature of the fine host particles by utilizing e.g. a hot air stream, so that the fine auxiliary particles can be fixed. As such an apparatus, Surfusing system manufactured by Nippon Pneumatic Mfg. Co., Ltd. may, for example, be mentioned.

The toner after the addition of the auxiliary agent may be subjected to a dry system classification operation, and a known method applicable to classification of the toner may be used.

The toner for developing an electrostatic charge image thus obtainable by the method of the present invention has a volume average particle diameter (Dv) of preferably at least 3 μm, more preferably at least 4 μm, further preferably at least 5 μm. It is preferably at most 9 μm, more preferably at most 8 μm, further preferably at most 7 μm. If the volume average particle diameter exceeds 9 μm, such may not be suitable for forming an image with a high resolution, and if it is less than 3 μm, such tends to be difficult to handle as a powder.

Further, as the toner for developing an electrostatic charge image obtainable by the method of the present invention, it is possible to obtain one containing little coarse particles and having a sharp particle diameter distribution, and the electrification property among individual particles tends to be uniform, such being desirable as a toner for developing an electrostatic charge image to accomplish a high image quality and high speed. Specifically, the value (Dv/Dn) obtained by dividing the volume average particle diameter (Dv) by the number average particle diameter (Dn), is preferably from 1.0 to 1.25, more preferably from 1.0 to 1.20, further preferably from 1.0 to 1.1. The closer to 1.0, the better. Here, the particle diameter of the toner for developing an electrostatic charge image is one measured by using a precise particle diameter distribution measuring apparatus Coulter counter, Multisizer II (manufactured by Beckman Coulter).

Further, in the toner for developing an electrostatic charge image obtainable by the method of the present invention, the content of particles having a particle diameter of from 0.6 to 2.12 μm as measured by a flow type particle image analyzer FPIA-2000 (manufactured by Sysmex Corporation) is preferably at most 15% by number, more preferably at most 10% by number, further preferably at most 5% by number, based on the total number of toner particles. This means that fine powder is less than a certain level, and when the fine powder is less, the flowability of the toner will be improved, and the electrification property tends to be uniform. It is most preferred that no fine powder is present, but such is practically difficult and requires an installation for the removal step. Therefore, the fine powder is usually at least 0.5% by number, preferably at least 1.0% by number.

Further, in the toner for developing an electrostatic charge image obtainable by the method of the present invention, the volume fraction of particles having a particle diameter of at least 25 μm as measured by Coulter counter is preferably at most 1%, more preferably at most 0.5%, further preferably at most 0.1%, particularly preferably at most 0.05%. It is most preferred that no coarse powder having a particle diameter of at least 25 μm is substantially present. Further, the volume fraction of particles having a particle diameter of at least 15 μm is preferably at most 2%, more preferably at most 1%, further preferably at most 0.1%. It is most preferred that also no powder having a particle diameter of at least 15 μm is substantially present. This means that a coarse powder is less than a certain level. According to the present invention, it is possible to produce a toner containing little coarse powder whereby consumption of the toner during continuous development is small, and the image can be stabilized.

Further, with respect to the shape of the toner for developing an electrostatic charge image, the 50% circularity as measured by using a flow type particle image analyzer FPIA-2000 is preferably at least 0.90, more preferably at least 0.92, further preferably at least 0.94. If the 50% circularity is less than the above range, there may be a case where the image density decreases due to deterioration of the electrification by deposition failure of an auxiliary agent. Further, such a 50% circularity is at most 0.99, preferably at most 0.98. If the 50% circularity exceeds the above range, cleaning failure may result.

Further, at least one of peak molecular weights by GPC (gel permeation chromatography) of the THF soluble content of the toner for developing an electrostatic charge image in the present invention is preferably at least 30,000, more preferably at least 40,000, further preferably at least 50,000 and preferably at most 200,000, more preferably at most 150,000, further preferably at most 100,000. If the peak molecular weight is lower than the above range, there will be a difficulty in the mechanical durability in a non-magnetic one component developing system, and if the peak molecular weight is higher than the above range, the low temperature fixing property or fixing strength tends to deteriorate, and transparency as a full color toner tends to be low, such being undesirable.

The toner for developing an electrostatic charge image obtainable by the method of the present invention, may be used for either a magnetic two component developer wherein a magnetic powder such as ferrite or magnetite is co-existent as a carrier to transport the toner to the electrostatic latent image portion by magnetic force, or a magnetic one-component developer having such a magnetic powder contained in the toner, or a non-magnetic one component developer employing no such magnetic powder. However, in order to obtain the effect of the present invention distinctly, it is particularly preferred to use it for a non-magnetic developer. Further, the toner obtainable by the present invention has an extremely small amount of coarse particles present therein and thus is preferably useful as a toner in an image-forming method wherein the toner is frequently in contact with components constituting the image-forming apparatus, such as an image-forming method by a non-magnetic one component developing system or a contact developing system.

Further, the toner for developing an electrostatic charge image obtainable by the method of the present invention may be employed suitably for a black toner, a color toner or a full color toner.

Further, when it is used for the above-mentioned magnetic two component developer, the carrier to form the developer as mixed with the toner may be a known magnetic material such as an ion powder type, ferrite type or magnetite type carrier, or one having a resin coating applied on the surface thereof, or a magnetic resin carrier. As the resin for covering the carrier, a commonly known styrene resin, acrylic resin, styrene/acrylic copolymer resin, silicone resin, modified silicone resin or fluorinated resin, may, for example, be used, but the covering resin is not limited thereto. The average particle diameter of the carrier is not particularly limited. However, one having an average particle diameter of from 10 to 200 μm, is preferred. Such a carrier is preferably used in an amount of from 5 to 100 parts by weight, per 1 part by weight of the toner.

As described above, according to the method for producing the toner for developing an electrostatic charge image of the present invention, the toner host particles can be produced efficiently by a wet method, and yet, the amount of coarse particles present in the toner host particles is extremely small. Thus, it is possible to produce a toner for developing an electrostatic charge image excellent in the image characteristics, image quality and scratch resistance of a developing device.

Hereinafter, the image-forming device and the image-forming method of the present invention will be described with reference to a non-magnetic one component developer. The image-forming device to be used in the present invention comprises components selected from e.g. a toner-feeding roller, a layer thickness-regulating member, a developing roller, a toner-stirring component, etc. and a heat fixing toner of the present invention. Further, in the present invention, as the image-forming device, a cartridge type is preferably employed.

In a case where non-magnetic one component development is to be carried out, it is common that the layer thickness of the developer on the developing roller is controlled by a layer thickness-regulating member, and the developer is electrified by frictional contact of the developer with the layer thickness-regulating member. Here, the layer-thickness-regulating member may be of a type to press the developing roller or of a non-contact type. However, a member of the type to press the developing roller is preferred in that the developer is thereby efficiently electrified. Further, the developing roller of the present invention may be used in a developing system wherein it is not in contact with a photoconductor or in an developing system wherein it is in contact with a photoconductor. However, the contact system is preferred with a view to improving the developing efficiency.

As mentioned above, the toner for developing an electrostatic charge image of the present invention is excellent in image characteristics and image quality, and the excellent effects of the toner for developing an electrostatic charge image of the present invention will appear distinctly, when copying is carried out for at least 5,000 sheets, particularly preferably at least 10,000 sheets. Further, an image-forming device having a heat fixing toner of the present invention is free from scratching of the developing device such as the developing roller, free from scattering of the toner with a low consumption of the toner even in development treatment for a long time.

EXAMPLES

Now, the present invention will be described in further detail with reference to Examples, but it should be understood that the present invention is by no means restricted to the following Examples. In the following Examples, "parts" means "parts by weight", and "%" means "mass %".

Example 1

Production of Polymer Primary Particle Dispersion

Into a glass reactor equipped with a stirring device, a heating/cooling device, a concentrating device and a device for charging various raw materials and additives, 367 parts of deionized water and 0.268 part of sodium dodecylbenzene sulfonate (hereinafter referred to simply as "DBS") were charged and heated to 90° C. in a nitrogen stream. Then, the following initiator 1 was added, and then the following monomers and emulsifier were added over a period of 5 hours, and then, the initiator 2 was added over a period of 6 hours to carry out emulsion polymerization.

| | |
|---|---|
| MONOMERS | |
| Styrene | 77 parts |
| Butyl acrylate | 23 parts |
| Acrylic acid | 2.0 parts |
| Trichlorobromomethane | 1.2 parts |
| Hexanediol diacrylate | 1.3 parts |
| EMULSIFIER | |
| DBS | 0.25 part |
| Deionized water | 22 parts |
| INITIATOR 1 | |
| 8% hydrogen peroxide aqueous solution | 0.13 part |
| 8% ascorbic acid aqueous solution | 0.13 part |
| INITIATOR 2 | |
| 8% hydrogen peroxide aqueous solution | 0.72 part |
| 8% ascorbic acid aqueous solution | 0.72 part |

After completion of the polymerization reaction, a reaction system was cooled to obtain a milky white polymer primary particle dispersion. The average particle diameter of the obtained polymer primary particles was 0.160 μm (as measured by UPA, manufactured by Microtrac), the weight average molecular weight (Mw) was 100,000, and the peak molecular weight (Mp) was 45,000.

| FLOCCULATION STEP, AGING STEP (PRODUCTION OF TONER HOST PARTICLES) | |
|---|---|
| Polymer primary particle dispersion (as solid content) | 100 parts |
| Black colorant (MA100 emulsion, manufactured by Nippon Carbide Industries Co., Inc.) (as solid content) | 6.7 parts |
| Sodium chloride 1.0% aqueous solution (as solid content) | 4.0 parts |
| DBS | 0.02 part |
| Wax (HYTEC E-433N, manufactured by Toho Chemical Industry Co., Ltd.) | 5.0 parts |

The above materials were mixed and, with stirring, heated from 25° C. to 50° C. at a rate of 1° C./min, then held at 50° C. for two hours, then heated to 60° C. and held for two hours, and then held for further 30 minutes, and then DBS was added to complete the flocculation step. Then, the temperature was raised to 72° C. and held for one hour, then raised to 80° C. and held for one hour, and then raised to 90° C. and held for 5 hours to carry out an aging step, and then the temperature was cooled to room temperature to obtain a toner host particle dispersion A.

The solid content concentration of the toner host particle dispersion A was 19.5 mass %, the volume average particle diameter measured by precision particle diameter distribution measuring apparatus Coulter counter, Multisizer II manufactured by Beckman Coulter (hereinafter referred to simply as "Coulter counter") was 7.1 μm (deviation factor: 25%), and the volume fraction of at least 25 μm was 1%. Here, the volume average particle diameter was measured by using, as a dispersion medium, Isotone II manufactured by Beckman Coulter and dispersing the particles so that the dispersoid concentration became 0.03 mass %.

Further, the 50% circularity measured by flow type particle image analyzer FPIA-2000, was 0.96, and the peak molecular weight (Mp) was 44,000. Here, the above 50% circularity was measured as follows and defined as follows. Namely, the toner host particles were dispersed in the dispersion medium (Isotone II, manufactured by Beckman Coulter) so that they would be within a range of from 5,720 to 7,140 particles/μL, and using the flow system particle image analyzer (FPIA-2000, manufactured by Sysmex Corporation (former Toa Medical Electronics)), the measurement was carried out under the following device conditions, and the obtained value is defined as "the average circularity". In the present invention, the same measurement is carried out three times, and an arithmetic average of three "average circularity" is adopted as the "average circularity".

Mode: HPF

HPF analyzed amount: 0.35 μL

HPF detected number of particles: 2,000 to 2,500 particles

Screening Step

The toner host particle dispersion A having a solid content concentration of 19.5 mass % was subjected to wet-system screening by means of Sato-type vibrating screen manufactured by Koei Sangyo Co., Ltd. using a circular screen with a diameter of the screening surface (i.e. a diameter of "the opening portion for screening within the fixed portion") being 700.0 mm. As a screen, a mesh net screen with a mesh size of 24 μm made of a polyester was used in one stage and, using the above circular screen as a supporting screen, set thereon without applying any tension to the screening surface. The phase angle of the vibrating screen was set to be 20°.

The area ($S_1$) of the opening portion for screening within the fixed portion of the above screen was $n \times 0.3500^2 = 0.38485$ $m^2$ and the area ($S_2$) when the screen present within the fixed portion was spread flatly was 0.38547 $m^2$. Further, the mesh size of the above screen was 24 μm, and the Young's modulus of the polyester constituting the above screen was 5.8 GPa. The diameter of the wire constituting the mesh net was 42 μm. This screen was hauled up in a stationary state without applying any tension, whereby the angle between the hauled up screen and the horizontal direction of the fixed portion of the screen was 3.3°. Further, when this screen was hauled up in a stationary state without applying any tension, the maximum sagging height was 20 mm. The above Young's modulus was determined by ASTM D882-64T.

The feeding rate of the toner host particle dispersion was 1 $m^3$/hr. During the step of screening the toner host particles, the above screen was wrinkled, and the wrinkles were moving. Namely, the wrinkles formed at certain locations disappeared, and wrinkles appeared at other locations, thus forming dynamically waving wrinkles. Further, during the step, the dispersion of toner host particles was moved outwardly from the center of the screen by the vibration given to the screen.

The mesh size was 24 μm (M=24), and the wire diameter was 42 μm (r=42), and thus, in the formula (1), $$\text{Right-hand side} = \{1/(24^2 + 42^2 + 2 \times 24 \times 42)\} \times 10^8 \times 0.6$$
$$= 13{,}774 \text{ (number/cm}^2\text{)}$$

On the other hand, with respect to the left-hand side in the formula (1) (Y (number/$cm^2$) being the number of particles of at least the mesh size of the screen present on the screen), the measurement was carried out ten times by changing the time and locations, whereby the average value of the ten times was 1,300 (number/$cm^2$).

Here, Y was obtained by the following method. Namely, in 50 ml of the dispersing medium (Particle sheath liquid, manufactured by Sysmex Corporation), 0.5 ml of the dispersion of the toner host particles before introducing to the screen was dispersed, and the number of particles having sizes of at least the mesh size of the screen was measured under the following device conditions by using a flow type particle image analyzer (FPIA-2100, manufactured by Sysmex Corporation)

Mode: LPF

LPF analyzed amount: 0.35 μL

LPF detected number of particles: number of particles of at least the mesh size of the screen From the above results, the concentration P (number/ml) of the number of particles having sizes of at least the mesh size of the screen contained in the dispersion of toner host particles before introduction to the screen, was calculated.

Then, the time from the supply of the dispersion of toner host particles to the screen until it was discharged out of the screen without passing through the screen, was calculated to obtain a retention amount of the dispersion of toner host particles on the screen, and the retention amount was divided by the area of the screen to calculate the raw material retention amount Q per unit area (ml/cm$^2$). Then, the raw material retention amount Q per unit area (ml/cm$^2$) was multiplied by the concentration P (number/ml) of the number of particles having sizes of at least the mesh size of the screen to calculate the number (Y) of the particles having sizes of at least the mesh size of the screen present on the screen. For Y, the same measurement was carried out three times with respect to the same sample, and the average value was taken as Y.

Further, the shape of the minimum opening unit (the shape of the mesh opening) of the screen was approximately square of 24 μm×24 μm in a stationary state, but when visually observed during the screening step, such a shape was three-dimensionally deformed from the stationary state (approximately flat square) by the vibration during the screening step, as dynamically waving wrinkles were three-dimensionally observed. The physical properties and state of the screen are summarized in Table 2.

The volume average particle diameter of the toner host particles after the screening was 7.1 μm (variation coefficient: 25%) as measured by Coulter counter, the volume fraction of toner host particles of at least 25 μm was 0.03%, the volume fraction of toner host particles of at least 15 μm was 0.08%, and the 50% circularity was 0.95 as measured by FPIA-2000.

Washing Step 26.1 parts, as solid content, of the toner host particle dispersion A was transferred to a filter dryer (manufactured by Tanabewilltec, TR-25F model, filtration area: 0.24 m$^2$) having a filter cloth (made of polypropylene, quantity of airflow: 5 cc/cm$^2$·min) attached to an isolated sieve plate at a lower portion in a container. The electric conductivity of the dispersion at that time, was measured by RACOM tester (manufactured by Eutech Inst. Pte. Ltd.) and found to be 15.4 mS/cm.

Then, the container was closed and pressurized to is 1.9 kg/cm$^2$, and then a drain cock below the sieve plate was opened to carry out filtration under an elevated pressure. At that time, stirring vanes in the container were moved above the liquid surface, and when a cake surface appeared along with the progress of filtration, the stirring vanes were, while being rotated at 5 rpm, pressed against the cake surface to remove water (hereinafter this operation will be referred to simply as "smoothing").

Then, 30 parts of deionized water (electric conductivity: 0.5 μS/cm) and 0.3 part of a 2 wt % citric acid aqueous solution were added into the container, and the cake was re-dispersed with stirring at 30 rpm, and after stirring for one hour, pressure filtration and smoothing were carried out again. The electric conductivity of the drainage water was 1.05 mS/cm. Washing with water containing a citric acid aqueous solution was carried out again under the same conditions, whereby the electric conductivity of the drainage water decreased to 480 μS/cm.

Further, with only 30 parts of deionized water, stirring/washing (30 rpm/15 minutes) was carried out, and pressure filtration and smoothing were carried out under the same conditions. Washing with only deionized water was repeated 8 times, and the electric conductivities of the drainage water at the time of washing 8 times were sequentially 70.5 μS/cm, 35.2 μS/cm, 18.0 μS/cm, 11.6 μS/cm, 8.0 μS/cm, 6.5 μS/cm, 4.2 μS/cm and 2.9 μS/cm. The water content at that time was 30%.

Further, the volume average particle diameter of the toner host particles measured by Coulter counter was 7.1 μm (variation coefficient: 25%), and the volume fraction of at least 25 μm was 0.01%. Further, the shape was measured by flow type particle image analyzer FPIA-2000, whereby the 50% circularity was 0.96.

Drying Step

Then, warm water was circulated to the stirring vanes and to a jacket portion around the filter dryer apparatus to adjust the internal temperature to be 43° C., and with stirring at 30 rpm, the interior of the system was vacuumed (from 600 to 1,300 Pa) to dry the toner host particles. At that time, on the vacuum side, a route provided with a bag filter (made of Tetron, quantity of airflow: 300 cc/(cm$^2$·min)) and a valve for jetting nitrogen gas, was provided to prevent scattering of the dried toner to the vacuum side and to return toner host particles scattered in the container by pulse-jetting nitrogen gas to the filter every predetermined time. After vacuum drying under heating for 10 hours, the temperature was lowered and the pressure was regained with dry nitrogen, whereupon the discharge outlet at a side portion of the container was opened, and the stirring vanes were rotated, whereby the toner host particles were taken out as being pressed out of the discharge outlet. The recovery rate to the charged solid content at that time was 94%, and the water content of the toner host particles was 0.5%.

Step of Adding Auxiliary Agent

To the dried product of toner host particles, 0.1 part (0.4 part based on toner host particles) of silica treated for hydrophobicity (manufactured by Wacker-Chemie HmbH, tradename "Wacker HDK H30TD"; average particle diameter: 0.008 μm) was added, followed by stirring by a Henschel mixer, to obtain a toner for developing an electrostatic image.

The volume average particle diameter of the obtained toner for developing an electrostatic charge image, as measured by Coulter counter, was 7.1 μm (variation coefficient: 25%), the volume fraction of at least 25 μm was 0.03%, the volume fraction of at least 15 μm was 0.08%, the 50% circularity was 0.95 as measured by FPIA-2000, and the particle diameter, particle diameter distribution and shape were substantially the same as before the washing treatment.

Practical Printing Test

With respect to the obtained toner for developing an electrostatic charge image, a continuous practical printing test was carried out at a printing rate of 5% by using N4 modified machine manufactured by Casio (an image-forming device of non-magnetic one component system wherein the photoconductor is an organic photoconductor). The image density (ID) of a fixed image thereby obtained was measured by X-rite 938

(illuminant C), and the electrostatic charge of the toner was measured by g/m meter (Model 1210HS) manufactured by TREK Company. They were, respectively, measured at the initial stage of printing and upon printing 5,000 sheets. The results are summarized in Table 3.

At the initial stage, ID was 1.6, and the electrostatic charge was −15.8 μC/g; after printing 5,000 sheets, ID was 1.5, and the electrostatic charge was −14.5 μC/m; and also after 10,000 sheets, stabilized characteristics and good image quality were obtained.

Further, with respect to the fixed image, dripping of the toner (a phenomenon wherein fixing of the toner in the form of e.g. spots is observed at a portion other than the developed portion of the electrostatic latent image) was evaluated by the following standards, whereby no dripping was observed at 10,000 sheets.

No dripping was observed at 10,000 sheets: ○

Dripping observed from 6,000 to 10,000 sheets: Δ

Dripping observed at less than 6,000 sheets: X

Comparative Example 1

A toner for developing an electrostatic charge image was obtained in the same manner as in Example 1 except that the wet system screening step was not carried out.

With respect to this toner for developing an antistatic charge image, the volume fraction of particles is of at least 25 μm was 1.5% as measured by Coulter counter. Further, a practical printing test was carried out in the same manner as in Example 1, whereby defects such as black cores, white cores, white streaks and scattering of the toner were observed, which were considered to be attributable to the group of coarse particles. The results are shown in Table 3.

Comparative Example 2

An operation up to the step of adding an auxiliary agent was carried out in the same manner as in Example 1 except that the wet system screening step was not carried out. With respect to the obtained particles having the auxiliary agent added, screening was carried out by an ultrasonic sieve (Vibrasonic model C600 type, manufactured by Russell Company) using a screen of 200 mesh, to obtain a toner for developing an electrostatic charge image.

With respect to this toner for developing an electrostatic charge image, the volume fraction of particles of at least 25 μm was 0.9% as measured by Coulter counter. A practical printing test was carried out in the same manner as in Example 1 by using the obtained toner for developing an antistatic charge image, whereby defects such as black cores, white cores, white streaks and scattering of the toner were observed, which are considered to be attributable to a group of coarse particles. The results are summarized in Table 3.

Further, using a net with mesh openings finer than 200 mesh, screening was attempted. However, due to agglomeration of particles to one another, majority of toner particles which should be a product smaller than the mesh size was discharged out of the system from the screen together with coarse particles, whereby the yield was not a practical level.

Comparative Example 3

An operation up to the drying step was carried out in the same manner as in Example 1 except that the wet system screening step was not carried out. With respect to the obtained toner host particles, coarse particle classification was carried out by means of an air stream classifier (325TSP, manufactured by Alpine) before adding an auxiliary agent. Then, the step of adding an auxiliary agent was carried out in the same manner as in Example 1 to obtain a toner for developing an electrostatic charge image.

With respect to this toner for developing an electrostatic charge image, the volume fraction of particles of at least 25 μm was 0.6% as measured by Coulter counter. Using the obtained toner for developing an electrostatic charge image, a practical printing test was carried out in the same manner as in Example 1, whereby defects such as black cores, white cores, white streaks and scattering of the toner were observed which are considered to be attributable to a group of coarse particles. The results are summarized in Table 3.

Comparative Example 4

A toner for developing an electrostatic charge image was obtained in the same manner as in Comparative Example 3 except that the coarse powder classification was carried out not before addition of the auxiliary agent but after addition of the auxiliary agent.

With respect to this toner for developing an electrostatic charge image, the volume fraction of particles of at least 25 μm was 0.3% as measured by Coulter counter.

Using the obtained toner for developing an electrostatic charge image, a practical printing test was carried out in the same manner as in Example 1, whereby the black cores, white cores, white streaks and scattering of the toner, which are considered to be attributable to a group of coarse particles, were less than in Comparative Example 3, but were still far more than in Example 1. Further, image defects such as deficiency in image density, fogging, etc., were observed which are attributable to peeling of the auxiliary agent, which is considered to have taken place during the air stream classification. The results are summarized in Table 3.

TABLE 1

| No. | Steps |
|---|---|
| Ex. 1 | Flocculation/aging → Screening → Washing → Filtration/drying → - - - → Adding auxiliary agent |
| Comp. Ex. 1 | Flocculation/aging → - - - → Washing → Filtration/drying → - - - → Adding auxiliary agent |
| Comp. Ex. 2 | Flocculation/aging → - - - → Washing → Filtration/drying → - - - → Adding auxiliary agent → Dry screening |
| Comp. Ex. 3 | Flocculation/aging → - - - → Washing → Filtration/drying → Air stream classification → Adding auxiliary agent |
| Comp. Ex. 4 | Flocculation/aging → - - - → Washing → Filtration/drying → - - - → Adding auxiliary agent → Air stream classification |

Comparative Example 5

Coarse particle classification was carried out in the same manner as in Example 1 except that, while the coarse powder classification was a wet system like in Example 1, as the screen, instead of the mesh net screen made of polyester and having a mesh size of 24 μm and a wire diameter of 42 μm, one made of a metal (SUS304) having a mesh size of 25 μm and a wire diameter of 23 μm, was used, and it was stretched by applying a tension of 20 N/cm at its center portion. As a result, the number of coarse particles on the screen continued to increase with the operation time, and when the number exceeded 26,500/cm$^2$ after 10 minutes from the initiation of the operation, the entire surface of the screen was clogged and the dispersion overflew from the outlet of the coarse particles, whereby it became impossible to continue the operation. Further, after the overflowing, the operation was stopped, the coarse particles on the screen were removed by washing with water and then the operation was repeated again, whereby upon expiration of 4 hours as the total operation time, the screen broke by fatigue, and it became impossible to continue the operation.

The mesh size was 25 μm (M=25), and the wire diameter was 23 μm (r=23), and thus, in the formula (1), $$\text{Right-hand side} = \{1/25^2 + 23^2 + 2\times25\times23)\}\times10^8\times0.6$$
$$= 26{,}041 \ (\text{number/cm}^2).$$

On the other hand, the left-hand side in the formula (1) (Y (number/cm$^2$) being the number of particles of at least the mesh size of the screen existing on the screen) exceeded 26,500/cm$^2$ as mentioned above, which was a value larger then 26,041/cm$^2$.

The area ($S_2$) when the portion present within the fixed portion of the above-mentioned screen made of a metal was spread flatly, was 0.38485 m$^2$, and was equal to the area ($S_1$) of the opening portion for screening within the fixed portion, being 0.83485 m$^2$. Further, the Young's modulus of the metal (SUS304) constituting the above screen was 197 GPa, and the diameter of the wire constituting the mesh net was 23 μm. This screen was hauled up in a stationary state without applying any tension, whereby there was no substantial sagging, and the angle between the hauled up screen and the horizontal direction of the fixed portion of the screen was 0.0 degree. The physical properties and state of the screen were summarized in Table 2.

During the step of screening toner host particles, no wrinkles were observed in the above screen, and the shape of the minimum opening unit of the screen (the shape of the mesh opening) did not change from the stationary state during the screening step.

Comparative Example 6

Coarse particle classification was carried out in the same manner as in Example 1 except that while the coarse powder classification was wet system in the same manner as in Example 1 and the screen used was made of the same polyester, the screen was set by applying a tension of 20 N/cm at its center. As a result, the number of coarse particles on the screen continued to increase with the operation time, and when the number exceeded 14,000/cm$^2$ after 14 minutes from the initiation of the operation, the entire surface of the screen was clogged, and the dispersion overflew from the outlet of the coarse particles, whereby it was impossible to continue the operation. The physical properties and the state of the screen were summarized in Table 2.

Comparative Example 7

Coarse particle classification was carried out in the same manner as in Example 1 except that while the coarse powder classification was wet system in the same manner as in Example 1, instead of the screen made of polyester, the screen made of the same metal (SUS304) as in Comparative Example 5, was used and set so that the center portion sagged 20 mm from the plane in which the is screen is usually set. As a result, the number of coarse particles on the screen continued to increase with the operation time, and when the number exceeded 26,500/cm$^2$ after 3 minutes from the initiation of the operation, the entire surface of the screen was clogged, and the dispersion overflew from the outlet of the coarse particles, and it was impossible to continue the operation. The physical properties and the state of the screen are summarized in Table 2.

TABLE 2

| | Both sides of the formula (1) | | Physical properties of the screen | | | State of the screen | | | |
|---|---|---|---|---|---|---|---|---|---|
| No. | Left-hand side Y of the formula (1) | Right-hand side of the formula (1) | Material | Young's modulus GPa | Mesh size μm | Tension N/cm | Angle of the screen | $S_1$ (m$^2$) | $S_2$ (m$^2$) |
| Ex. 1 | 1,300 | 13,774 | PES | 5.8 | 24 | Nil | 3.3° | 0.38485 | 0.38547 |
| Comp. Ex. 5 | 26,500 | 26,041 | SUS | 197 | 25 | 20 | 0.0° | 0.38485 | 0.38485 |
| Comp. Ex. 6 | 14,000 | 13,774 | PES | 5.8 | 24 | 20 | 0.0° | 0.38485 | 0.38485 |
| Comp. Ex. 7 | 26,500 | 26,041 | SUS | 197 | 25 | Nil | 3.3° | 0.38485 | 0.38547 |

In Table 2, "PES" represents polyester.

TABLE 3

| | Coarse particles in the toner for developing electrostatic charge image | | Evaluation of practical printing of 10,000 sheets | | |
|---|---|---|---|---|---|
| No. | Volume fraction of particles of at least 25 μm | Volume fraction of particles of at least 15 μm | Dripping of toner | Image quality | Image characteristics |
| Ex. 1 | 0.03% | 0.08% | ○ | Black cores/white spots/ white streaks/scattering of toner: Not observed | ID = 1.5 No fogging |

TABLE 3-continued

| No. | Coarse particles in the toner for developing electrostatic charge image: Volume fraction of particles of at least 25 μm | Volume fraction of particles of at least 15 μm | Evaluation of practical printing of 10,000 sheets: Dripping of toner | Image quality | Image characteristics |
|---|---|---|---|---|---|
| Comp. Ex. 1 | 1.5% | 2.0% | X | Black cores/white spots/ white streaks/scattering of toner: Observed | ID = 1.5 No fogging |
| Comp. Ex. 2 | 0.9% | 1.4% | X | Black cores/white spots/ white streaks/scattering of toner: Observed | ID = 1.5 No fogging |
| Comp. Ex. 3 | 0.6% | 0.9% | X | Black cores/white spots/ white streaks/scattering of toner: Observed | ID = 1.5 No fogging |
| Comp. Ex. 4 | 0.3% | 1.5% | X | Scattering of toner: Observed | ID = 0.8 Fogging observed |
| Comp. Ex. 5 | Impossible to continue the operation | | Impossible to obtain sufficient amount for evaluation of the practical printing | | |
| Comp. Ex. 6 | Impossible to continue the operation | | Impossible to obtain sufficient amount for evaluation of the practical printing | | |
| Comp. Ex. 7 | Impossible to continue the operation | | Impossible to obtain sufficient amount for evaluation of the practical printing | | |

When the screening step in the method for producing a toner for developing an electrostatic charge image of the present invention is carried out, continuous operation was possible without clogging of the screen or without breakage of the screen, and the toner for developing an electrostatic charge image, thereby obtained, contained an extremely small amount of coarse particles, was free from dripping of the toner, black cores, white spots, white streaks or scattering of the toner, and the image quality was good. Further, the toner was good also with respect to the image density and fogging and excellent in the image characteristics. Further, the consumption of the toner was little, and the toner was excellent also in the scratch resistance against the developing device.

INDUSTRIAL APPLICABILITY

The toner for developing an electrostatic charge image of the present invention has the above-mentioned effects, and accordingly, it is widely used as it is useful as a toner for developing an electrostatic charge image which can be used for a printing machine or a copying machine where uniform and high quality images are required in the case of carrying out electrostatic development at a high speed in a large amount, or in the case of carrying out electrostatic development continuously for a long period of time, or in the case of carrying out an electrostatic development in a high temperature high humidity environment. Further, it is possible to carry out continuous operation without clogging, whereby with a small size screen, a large treating ability can be obtained, the installation cost is small, and the useful life of the screen is long and the running cost can be suppressed at a low level, and thus, it may be used widely as a toner for developing an electrostatic charge image.

The entire disclosure of Japanese Patent Application No. 2005-241528 filed on Aug. 23, 2005 including specification, claims and summary is incorporated herein by reference in its entirety.

The invention claimed is:

1. A method for producing a toner for developing an electrostatic charge image, the method comprising screening a dispersion of toner host particles by a screen, wherein when the screening is carried out, the following formula (1) is satisfied:

$$Y \leqq \{1/(M^2+r^2+2Mr)\} \times 10^8 \times 0.6 \quad (1),$$

where Y is the number of particles (number/cm$^2$) existing on the screen and having sizes of at least the mesh size of the screen, M is the mesh size (μm) of the screen, and r is a diameter (μm) of wire constituting the screen, wherein vibration is exerted to the screen to let the screen form dynamically waving wrinkles thereby to carry out the screening of the dispersion of the toner host particles.

2. The method for producing a toner for developing an electrostatic charge image according to claim 1, wherein vibration is exerted to the screen to let the dispersion of the toner host particles move outwardly from the center of the screen, thereby to carry out the screening.

3. The method for producing a toner for developing an electrostatic charge image according to claim 2, wherein the toner host particles in the dispersion are prepared by a wet method.

4. The method for producing a toner for developing an electrostatic charge image according to claim 3, wherein the wet method is an emulsion polymerization flocculation method.

5. The method for producing a toner for developing an electrostatic charge image according to claim 1, wherein the screen is made of, as the main material, a material having a Young's modulus of at most 100 GPa, and the area ($S_2$) of the screen when the screen existing in a fixed portion of the screen is spread flatly, is larger than the area ($S_1$) of the opening for screening in the fixed portion of the screen.

6. The method for producing a toner for developing an electrostatic charge image according to claim 1, wherein the screen is installed as supported by a support screen.

7. The method for producing a toner for developing an electrostatic charge image according to claim 1, wherein the screen forms dynamically waving wrinkles by vibration during the screening.

8. The method for producing a toner for developing an electrostatic charge image according to claim 1, wherein a shape of a minimum opening unit of the screen to let particles pass therethrough, changes from a stationary state by vibration during the screening.

9. The method for producing a toner for developing an electrostatic charge image according to claim 1, wherein the vibration is generated by rotation of eccentric weights.

10. The method for producing a toner for developing an electrostatic charge image according to claim 1, wherein the vibration is generated by rotation of eccentric weights set to have a phase angle within a range of from 5° to 30°.

11. The method for producing a toner for developing an electrostatic charge image according to claim 1, wherein the mesh size of the screen is from 10 μm to 50 μm.

* * * * *